US006095239A

United States Patent [19]

Makino et al.

[11] Patent Number: 6,095,239

[45] **Date of Patent: *Aug. 1, 2000**

[54] INTEGRAL-TYPE HEAT EXCHANGER

[75] Inventors: Kenji Makino; Hiroyasu Koizumi; Minoru Tsuchiya; Kunio Matsugi; Hiroshi Chikuma; Satoshi Ishihara; Makoto Tajima; Yoshiki Tsuda; Toshiaki Yamamoto; Hideki Kobayashi; Katsumi Nakamura; Junichi Enari; Mamoru Baba, all of Tokyo, Japan

[73] Assignee: Calsonic Kansei Corporation, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/909,936

[22] Filed: Aug. 12, 1997

[30] Foreign Application Priority Data

| | | | |
|---|---|---|---|
| Aug. 12, 1996 | [JP] | Japan | 8-212412 |
| Nov. 19, 1996 | [JP] | Japan | 8-307655 |
| Dec. 3, 1996 | [JP] | Japan | 8-322676 |
| Dec. 25, 1996 | [JP] | Japan | 8-345235 |

[51] Int. Cl.[7] ..... F28D 21/00

[52] U.S. Cl. ..... 165/140; 165/135

[58] Field of Search ..... 165/135, 140, 165/149, 173

[56] References Cited

U.S. PATENT DOCUMENTS 5,046,554 9/1991 Iwasaki et al. .

*Primary Examiner*—Allen Flanigan

*Attorney, Agent, or Firm*—Sughrue, Mion, Zinn, Macpeak & Seas, PLLC

[57] ABSTRACT

Tanks of a first heat exchanger have plane sections perpendicular to bottoms having a plurality of tube insertion holes formed therein. Tanks of a second heat exchanger with circular cross sections have bottoms having a plurality of tube insertion holes formed therein. The axes of the tube insertion holes of the first and second heat exchangers are held in parallel with each other. The second heat exchanger is in contact with the plane sections of the first heat exchanger tank.

3 Claims, 25 Drawing Sheets

INTEGRAL-TYPE HEAT EXCHANGER

BACKGROUND OF THE INVENTION

1. Field of the Invention

The present invention relates to an integral-type heat exchanger comprising two-types of heat exchangers which are connected together or disposed adjacent to each other prior to mount on an automobile.

2. Description of the Related Art

So-called integral heat exchangers have been recently developed, wherein a condenser for cooling purposes is connected to the front face of a radiator. An example of the integral heat exchangers is disclosed in Japanese Patent Publication No. Hei. 1-224163.

FIG. 38 illustrates an integral-type heat exchanger as disclosed in Japanese Patent Publication No. Hei. 1-247990. This heat exchanger comprises a first heat exchanger 1 to be used as a radiator and a second heat exchanger 3 to be used as a cooling condenser, both of which are positioned in parallel with each other.

The first heat exchanger 1 comprises an aluminum upper tank 5 which is opposite to and spaced a given distance from a lower aluminum tank 7, and an aluminum tube 9 connecting together the upper and lower tanks 5 and 7. The second heat exchanger 3 comprises an upper aluminum tank 11 which is opposite to and spaced a given distance from a lower aluminum tank 13, and an aluminum tube 15 connecting together the upper and lower tanks 11 and 13.

As illustrated in FIG. 39, the aluminum tubes 9 and 15 of the first and second heat exchangers 1 and 3 are in contact with an aluminum fin 17 spreading across the aluminum tubes. The first and second heat exchangers 1 and 3 form a heat radiation section (a core) 19 by means of the common fin 17.

The first and second heat exchangers 1 and 3, and the heat dissipation section (the core) 19 are integrally bonded together by brazing.

In this conventional integral-type heat exchanger, all of the upper tanks 5, 11 and the lower tanks 7 and 13 of the first and second heat exchangers 1 and 3 are formed so as to have a circular cross section, thereby presenting the following problems.

Normally, the first heat exchanger 1 to be use as the radiator is larger than the second heat exchanger 3 to be used as the cooling condenser, and the reason is as follows. Generally, the amount of coolant flowing in the radiator is larger than that in the cooling condenser. Therefore, it should be necessary to decrease the resistance of the tank of the radiator to the coolant flowing therein as compared with the tank of the cooling condenser. Further, it should be necessary to increase the capacity of the tank of the radiator as compared with the tank of the cooling condenser. Accordingly, the radiator becomes larger than the cooling condenser.

Therefore, as illustrated in FIG. 40, the distance (or a tubing pitch La) between the tubes 9 and 15 becomes large because of the difference in diameter between the upper tanks 5 and 11, as well as between the lower tanks 7 and 13, thereby increasing the thickness Wa of the heat radiation section (core) 19. The area 16 between the tubes 9 and 15 becomes a dead space.

As illustrated in FIG. 41, with the purpose of reducing the thickness of the heat radiation section (core) 19, a tube hole 20 formed in the upper and lower tanks 5 and 7 of the first heat exchanger 1 could be moved so as to become closer to the second heat exchanger 3. However, such a modification requires a difficult boring operation, and hence this idea is not suitable in view of practicality.

SUMMARY OF THE INVENTION

This invention has been conceived to solve the aforementioned problem, and the object of the present invention is to provide an integral-type heat exchanger which enables a reduction in the thickness of a heat radiation section (or core) in a simple structure.

According to the present invention, there is provided an integral-type heat exchanger for an automobile, comprising: (1) a first heat exchanger including: a pair of first tanks, each first tank having a plane section perpendicular to a first surface thereof in which a plurality of first tube insertion holes are formed; and a plurality of first tubes to be inserted into the first tube insertion holes so as to connect the pair of first tanks; and (2) a second heat exchanger including: a pair of second tanks, each second tank having a substantially circular cross section and having a plurality of second tube insertion holes; and a plurality of second tubes-to be inserted into the second tube insertion holes so as to connect the pair of second tanks; and (3) a plurality of fins disposed between a plurality of first tubes and between a plurality of second tubes; wherein axes of the first and second tube insertion holes are held in parallel with each other, and the above (1) to (3) members are mounted on the automobile at the same time while the plane section of the first tank is brought into contact with, or is close to the second tank.

Further, additional constitutional characteristics and effect of the present invention will described hereinafter.

According to the present invention, the tubes of the first and second heat exchangers are held in parallel with each other, and the tanks of the second heat exchanger are brought into contact with the plane sections of the first heat exchanger. As a result, it is possible to minimize the distance between the tubes.

Further, the length of the second heat exchanger can be minimized.

In the heat exchange tank according to the present invention, the end plates can be attached to the first and second heat exchange tanks by fitting the block members of the end plates into the heat exchange tanks.

In the heat exchange tank according to the present invention, the lock members of the end plates act as whirl-stops of the end plates, and hence the end plates can be reliably fitted into the first and second heat exchange tanks.

Further, after the partition has been fitted into at least one attachment slot formed in the second heat exchanger tank, a locking section of the partition is folded, thereby enabling fixing of the partition to the second heat exchanger tank.

Further, heat propagating through the corrugated fin from the first or second heat exchanger having a high operating temperature to the second or first heat exchanger having a lower operating temperature is effectively exchanged with air by the parallel louvers. As a result, a thermal influence is prevented from acting on the second or first heat exchanger having a low operating temperature.

The wind passing through both heat exchangers can flow in the direction of ventilation without increasing resistance of the parallel louvers.

Still further, the first and second upper tanks or the first and second lower tanks are connected together by a joint member, and an upper/lower projection is formed in a jointed area between the portions of the joint member.

For example, in the event of a slight automobile collision, a collision force is divided between the first and second upper tanks or between the first and second lower tanks via the joint member, whereby the collision force is received by the first and second upper tanks or by the first and second lower tanks.

Furthermore, the first upper tank, the second upper tank or the first lower tank, the second lower tank, and the joint members are made of aluminum, and the joint members are connected at both ends connected to the first upper tank and the second upper tank or to the first lower tank and the second lower tank by brazing.

Mounting sections for use in mounting the integral-type heat exchanger tank to the body of a car are projectingly formed outside the first and second openings formed in the end plates.

The mounting sections are formed by fitting pins into amounting holes formed in the end plates.

A through hole is formed in a partition wall through which the first tank body and the second tank body are integrally formed with each other, and the through hole serves as a heat insulation space.

The first tank body and the second tank body are integrally molded from aluminum by extrusion, and the through hole is formed at the time of extrusion.

DETAILED DESCRIPTION OF THE PREFERRED EMBODIMENTS

Figure 1:
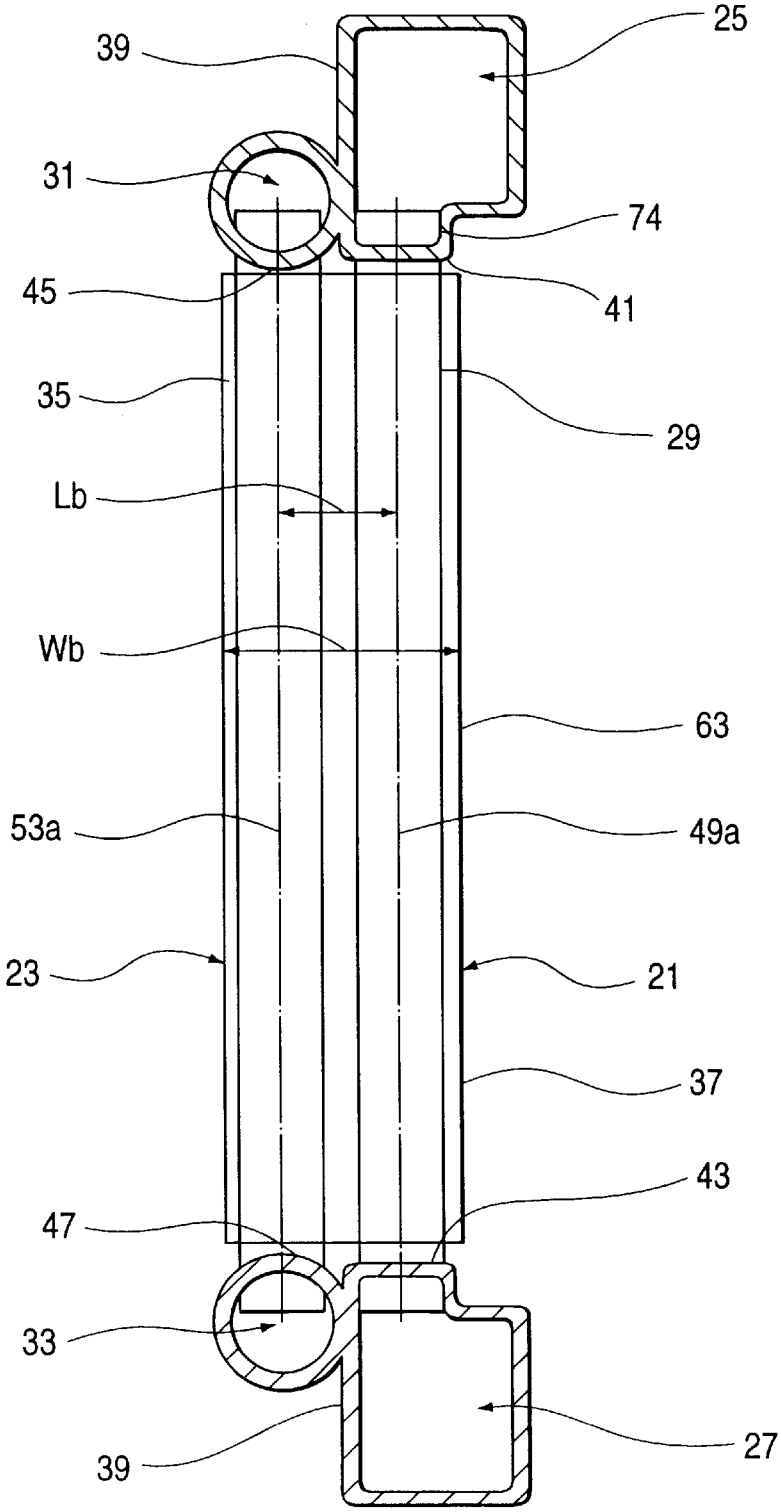
FIG. 1 is a cross sectional view illustrating an integral-type heat exchanger of a first embodiment of the invention.

Embodiments of the present invention will be described in detail with reference to the accompanying drawings.

1st Embodiment

FIGS. 1 to 4 illustrate a first embodiment of an integral-type heat exchanger according to the present invention. In the drawings, reference numeral 21 designates a first heat exchanger constituting a radiator, and reference numeral 23 designates a second heat exchanger constituting a condenser. Incidentally, the inlet and outlet pipes, filler neck, or other members of the first and second heat exchangers are omitted in the drawings.

Tanks 25, 27 of the first heat exchanger 21 and the tanks 31, 33 of the second heat exchanger 23 are integrally molded from aluminum (e.g., A3003) by extrusion.

The tanks 25, 27 of the first heat exchanger 21 have rectangular cross sections, and the tanks 31, 33 of the second heat exchanger 23 have circular cross sections. The tanks 31, 33 of the second heat exchanger 23 are in contact with and are formed integrally with lower part of plane sections 39 formed in the side walls of the tanks 25, 27 of the first heat exchanger 21 through a joint (partition wall) 61. The axes 49*a* and 53*a* of the tube insertion holes 49, 51, 53, and 55 of the first and second heat exchangers 21 and 23 are held in parallel with each other. The second heat exchanger 23 is in contact with the plane sections 39 of the tanks 25, 27 of the first heat exchanger 21.

The plane section 39 is formed over the entire area on one side of each of the tanks 25 and 27 of the first heat exchanger 21 and becomes normal to the bottom surfaces 41 and 43 of the tanks 25 and 27.

Figure 2:
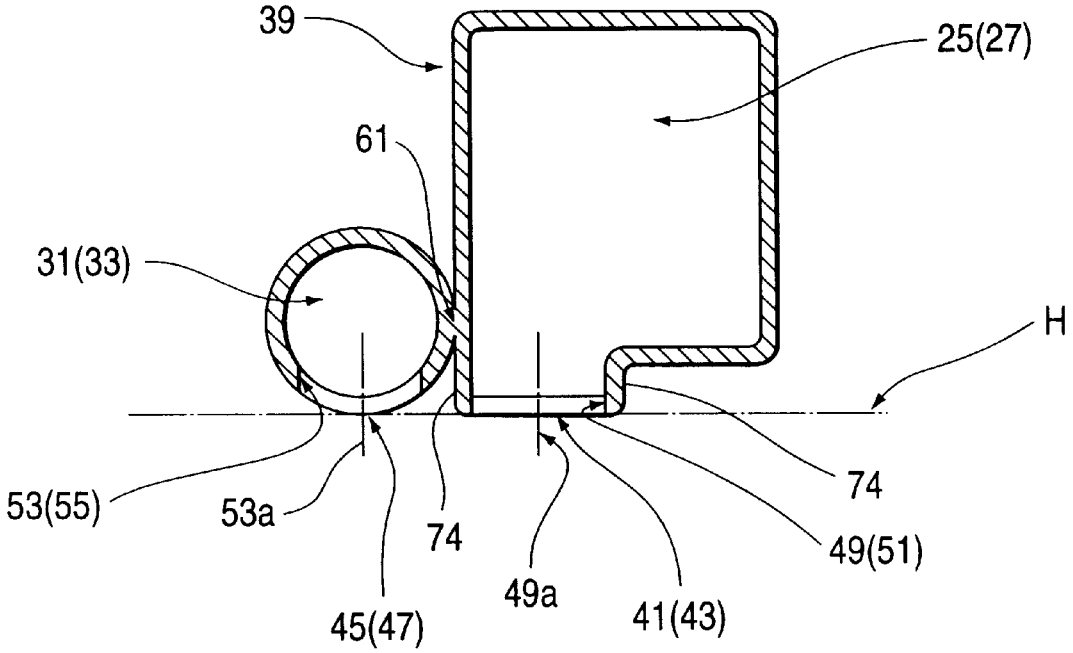
FIG. 2 is a cross sectional view illustrating tanks illustrated in FIG. 1.

As illustrated in FIG. 2, the bottoms 41, 43, 45, and 47 of the tanks 25, 27, 31, and 33 are positioned in line with a horizontal line H indicated by a dashed line.

Tube insertion holes 49, 51 are formed in the bottoms 41, 43 of the tanks 25, 27 of the first heat exchanger 21, and a tube 29 is inserted into the tube insertion holes 49 and 51. The tube insertion holes 49, 51 are formed perpendicularly to the bottoms 41, 43 of the tanks 25, 27 of the first heat exchanger 21.

Figure 18:
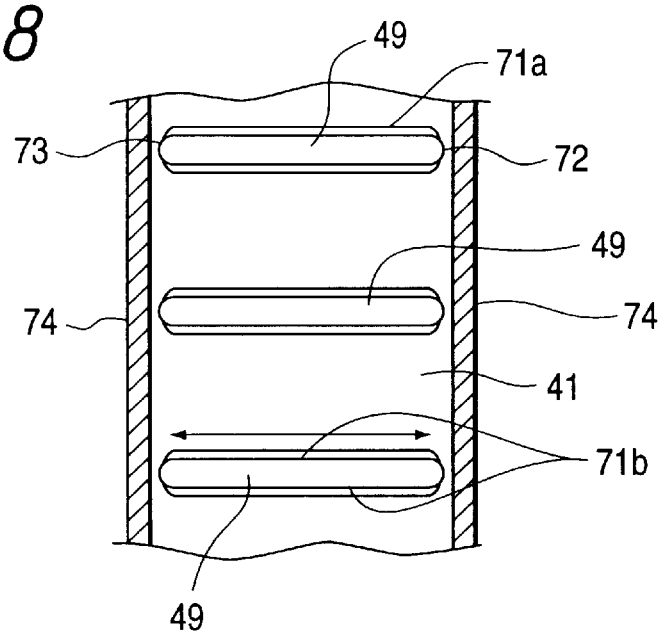
FIG. 18 shows an enlarged plan view of the bottom of the tank and the tube insertion holes.
Figure 20:
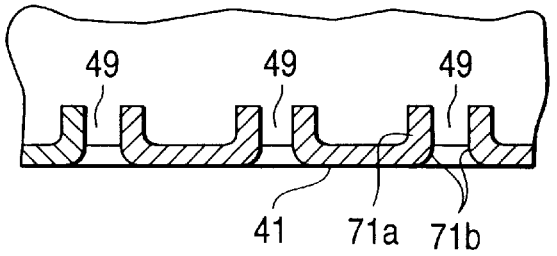
FIG. 20 shows an enlarged cross sectional view of the bottom of the tank and the tube insertion holes.

In more detail, as shown in FIGS. 18 and 20, the tube insertion holes 49 (holes 51 being omitted) are formed in the bottom 41 by burring from the bottom surface side. FIG. 18 shows an enlarged plan view of the bottom 41 of the tank 25 and the tube insertion holes 49, and FIG. 20 shows an enlarged sectional view thereof. The tube insertion holes 49 has parallel portions 71*b* and end portions 72, 73 having curved shape. Rising portions 71*a* are formed along the parallel portions 71*b*. The tube insertion holes 49 are extending to such degree that the end portions 72, 73 are located adjacent to a rising wall 74 of the tank 25 (for example, the gap between the end portions 72, 73 and the rising wall 74 is less than 0.5 mm). Further, it is allowed the tube insertion holes 49 to extend close to the end portions 72, 73. That is, the width of the tube insertion hole 49 is substantially same as the width of the tube 29, or slightly larger than the width of the tube 29, and the end portions 72, 73 are located just inside of the rising wall 74 of the tank 25. It is important that the brazed portions of the tank and the tube are brought into contact with each other, or are very adjacent to each other.

Figure 19:
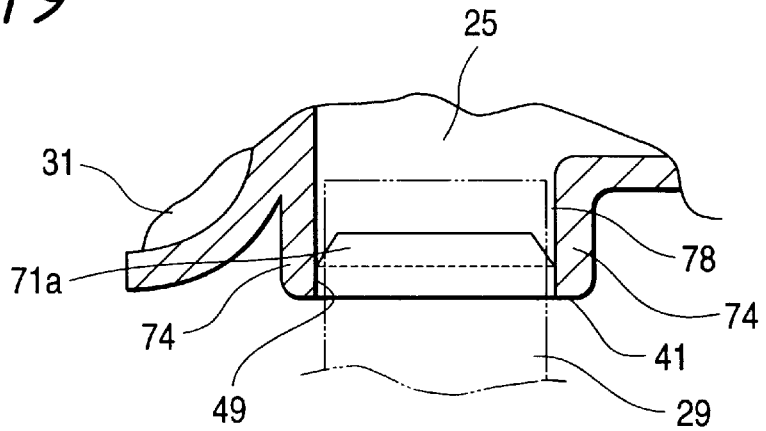
FIG. 19 shows a cross sectional view illustrating the state that the tube is inserted into the tube insertion hole.

When the tube 29 is inserted into and bonded to the tube insertion hole 49 by brazing as shown in FIG. 19, brazing material is gathered to a gap between the tube 29 and the rising wall 74 by capillary force, and brazing material gathering portion 78 is formed at the gap. Therefore, it can be prevented that the brazing material becomes deficient between the tube 29 and the rising wall 74 so as to bond the tube 29 to the tube insertion hole 49 certainly.

Further, with the purpose of reducing the thickness of the heat exchanger, the tube insertion holes 49, 51 are formed so as to be closer to the second heat exchanger 23 in the bottoms 41, 43 of the tanks 25, 27.

Tube insertion holes 53, 55 are formed in the bottom surfaces 45, 47 of the tanks 31, 33 of the second heat exchanger 23. A tube 35 is inserted into the tube insertion holes 53, 55. The tube insertion holes 53, 55 are formed perpendicularly to the bottoms 45, 47 of the tanks 31, 33 of the second heat exchanger 23.

A fin 37 is positioned so as to spread across the tubes 29, 35. Of course, it is possible to adopt the fin which is separated between the first and second heat exchangers 21 and 23, so that each first and second heat exchanger 21, 23 has the separated fin 37, 37 (this example being explained according to FIG. 28 afterward).

The tanks 25, 27 of the first heat exchanger 21, the tube 29, the tanks 31, 33 of the second heat exchanger 23, the tube 35, and the fin 37 are bonded together by brazing according to a customary method. A core 63 common to the first and second heat exchangers 21 and 23 is formed by combination of the tubes 29, 35 and the fin 37.

In the integral-type heat exchanger of the present embodiment having the aforementioned structure, the first and second heat exchangers 21 and 23 can be formed integrally with the smallest tube pitch Lb between the tubes 29, 35, because the tangential lines of the tanks 31, 33 of the second heat exchanger 23 are in line with the plane sections 39 of the tanks 25, 27 of the first heat exchanger 21. Accordingly, as compared with a conventional integral-type heat exchanger, the heat exchanger of the present invention eliminates the dead spaced corresponding to the fin 37 spreading across the tubes 29, 35, thereby enabling a reduction in the thickness Wb of the core 63.

The tank 25 (27) of the first heat exchanger 21 and the tank 31 (33) of the second heat exchanger 23 are integrally molded from aluminum by extrusion. The necessity for brazing these tanks which has been conventionally required is obviated. Therefore, when the tank 25 (27) of the first heat exchanger 21 is bonded to the tank 31 (33) of the second heat exchanger 23, a troublesome operation which is required to bring these tanks into alignment becomes unnecessary.

Figure 3:
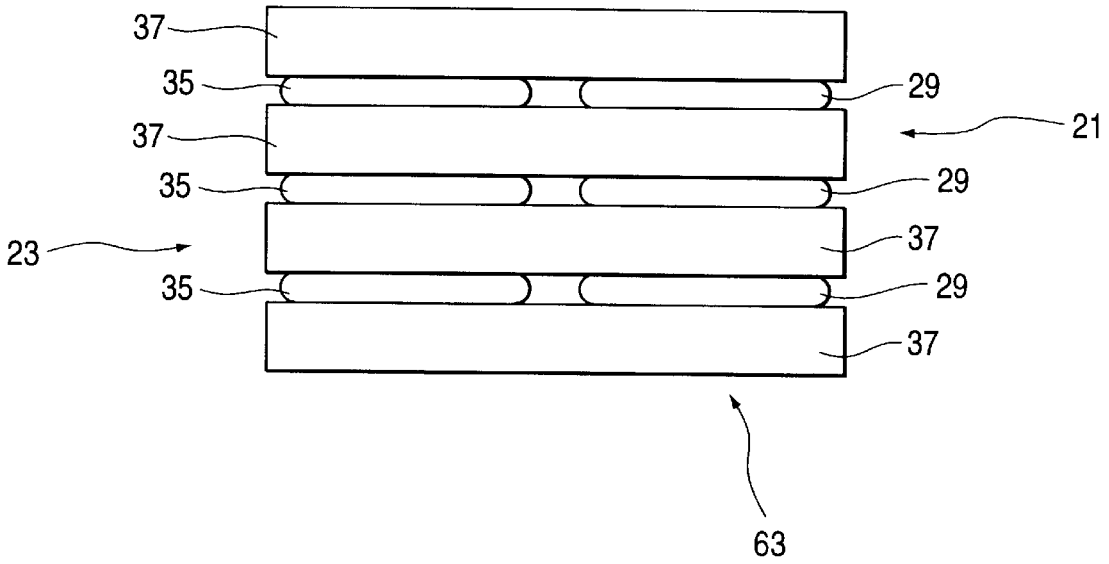
FIG. 3 is a plan view illustrating a core shown in FIG. 1.
Figure 4:
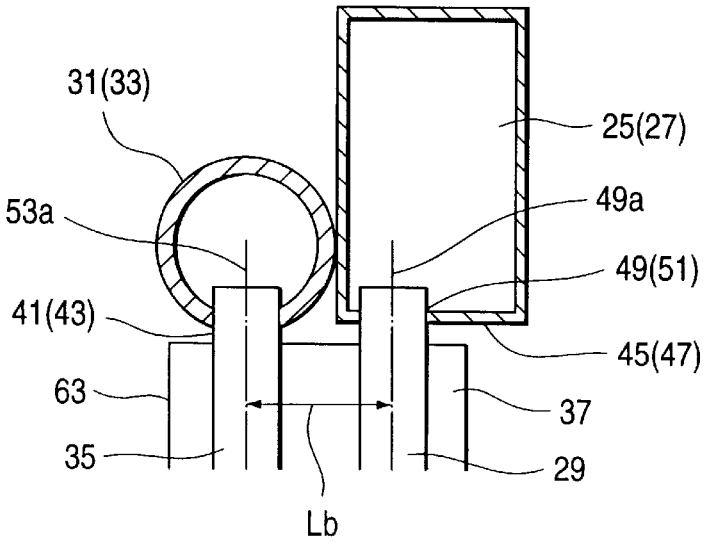
FIG. 4 is a cross sectional view illustrating of the modification of an integral-type heat exchanger in FIG. 1.

FIG. 4 illustrates a modified embodiment of the integral-type heat exchanger in FIGS. 1 to 3.

In this embodiment, the tank 25 (27) of the first heat exchanger 21 and the tank 31 (33) of the second heat exchanger 23 are formed separately from each other.

In this embodiment, the integral-type heat exchanger operates in the same way as does the heat exchanger of the previous embodiment, as well as presenting the same effect as that is presented by the heat exchanger of the previous embodiment, with the exception of the operation and effect due to aluminum extrusion-molded articles.

Further, in this embodiment, the tube insertion holes 49, 51 are formed in the bottoms 41, 43 of the tanks 25, 27 of the first heat exchanger 21 in such a manner that the tube insertion holes 49, 51 are formed close to the second heat exchanger 23. Under this construction, it is possible to reduce the tube pitch Lb between the tubes 29, 35.

Incidentally, in this embodiment, the tank 25 (27) of the first heat exchanger 21 and the tank 31 (33) of the second heat exchanger 23 are brought into contact with each other. However, both tanks 25 (27) and 31 (33) may be separated each other, that is, they may be disposed close to each other.

Figure 5:
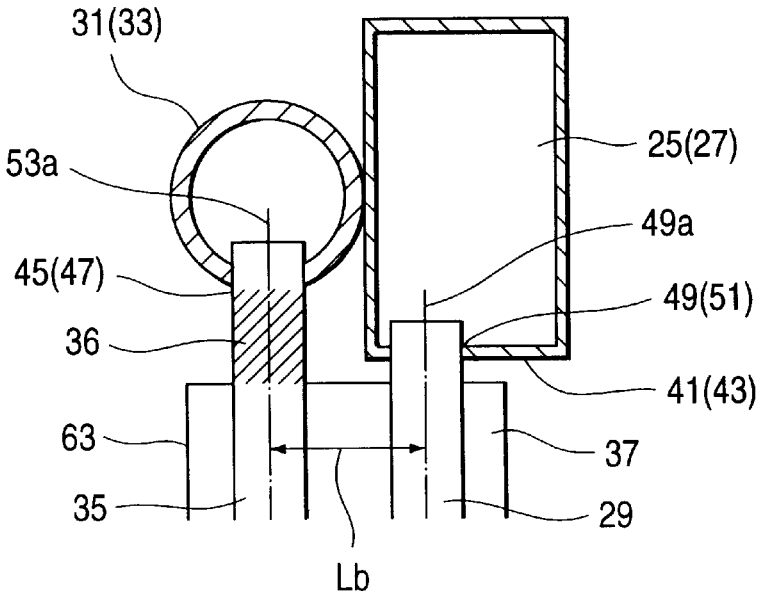
FIG. 5 is a cross sectional view illustrating of the modification of an integral-type heat exchanger in FIG. 1.

FIG. 5 is a modification of the integral-type heat exchanger illustrated in FIG. 1.

In this modification, the tanks 31, 33 of the second heat exchanger 23 are separated from the core 63.

Figure 6:
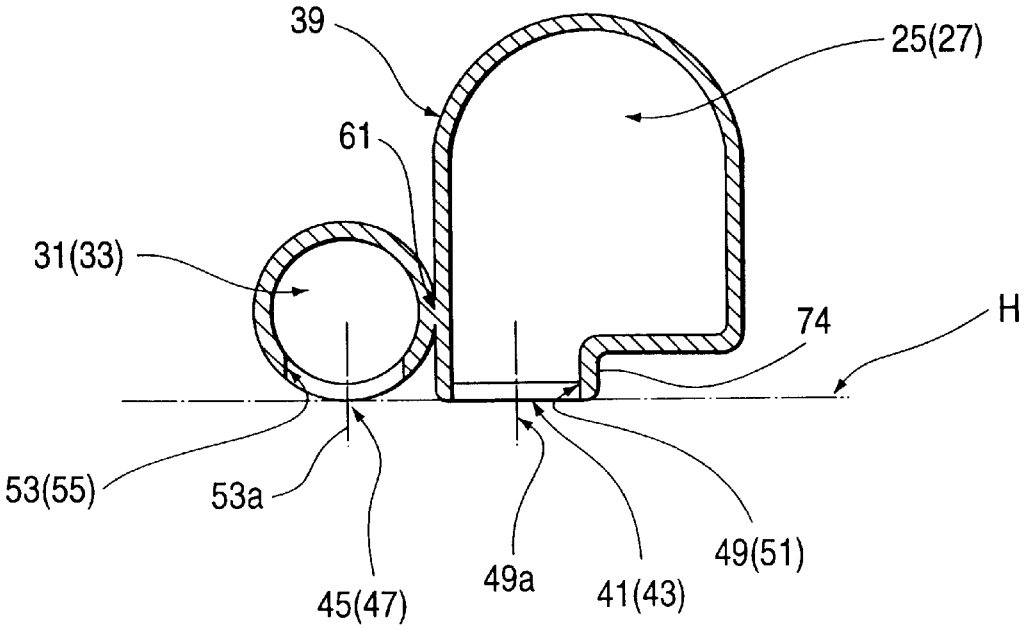
FIG. 6 is a cross sectional view of the modification of the integral-type heat exchanger tank illustrated in FIG. 2.

Although the explanation has been given of the case where the tanks 25, 27 of the first heat exchanger 21 have rectangular cross sections in the previous embodiments, the cross sections of the tanks are not limited to any particular shapes, so long as the plane sections 39 used for ensuring contact with the tanks 31, 33 of the second heat exchanger 23 can be formed. Particularly, if the first heat exchanger 21 is used as a radiator, the heat exchanger can be formed into an arbitrary shape because the radiator requires less pressure tightness that is required by the condenser. For example, as illustrated in FIG. 6, the tanks 25, 27 of the first heat exchanger 21 may not have rectangular cross sections, but a curved portion may be included in the shape of the tanks 25, 27. Further, the cross sections of the tanks 31, 33 is not limited to the circular cross section. For example, it may be an elliptic cross section.

2nd Embodiment

Figure 7:
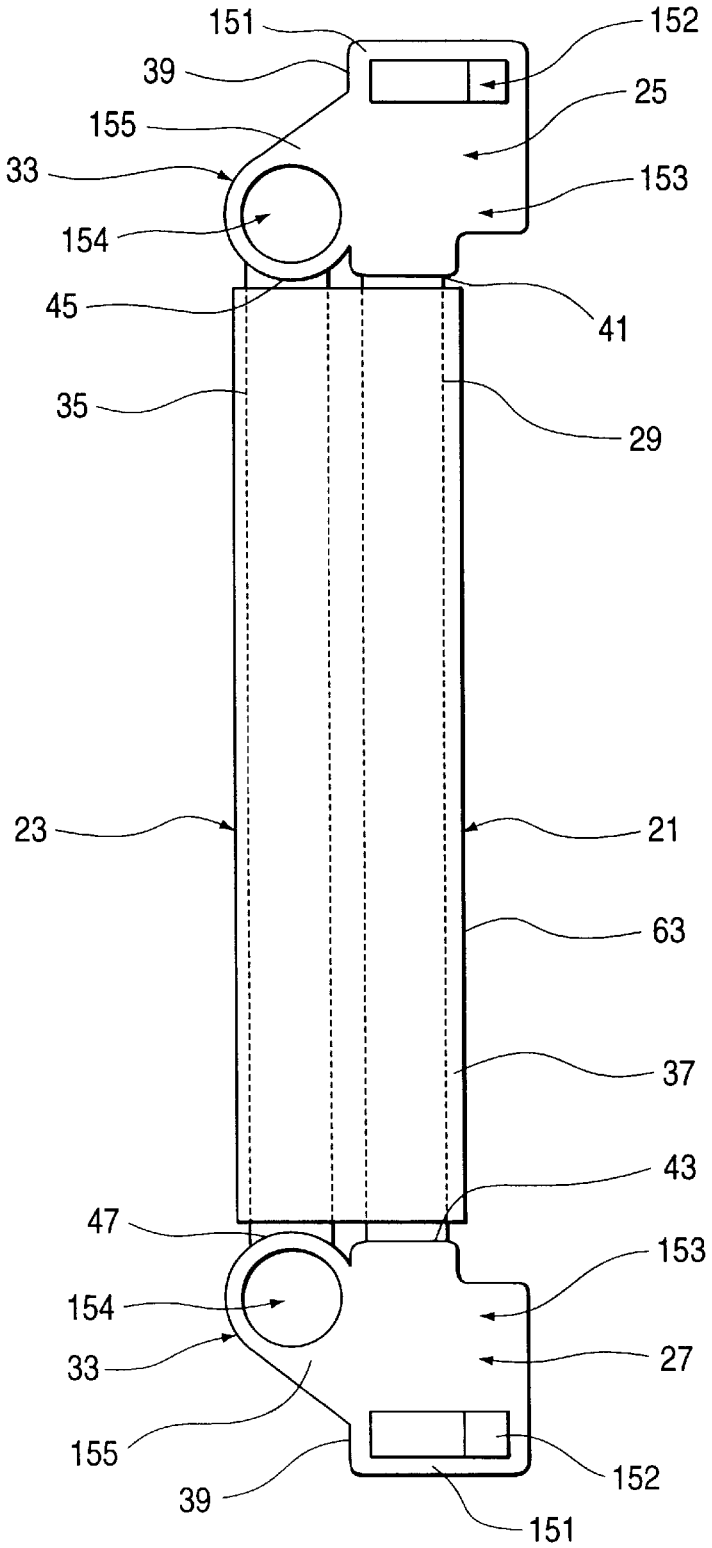
FIG. 7 is a sectional view illustrating a second embodiment of integral-type heat exchanger according to the present invention.

The details of a second embodiment of the present invention will be described hereinbelow with reference to FIGS. 7 to 10. In FIG. 7, the common fin 37 to the first and second heat exchangers is used. However, is may be possible to adopt separated fins of each first and second heat exchangers.

FIG. 7 illustrates an integral-type heat exchanger which employs integral-types heat exchanger tanks according to this embodiment.

Figure 8:
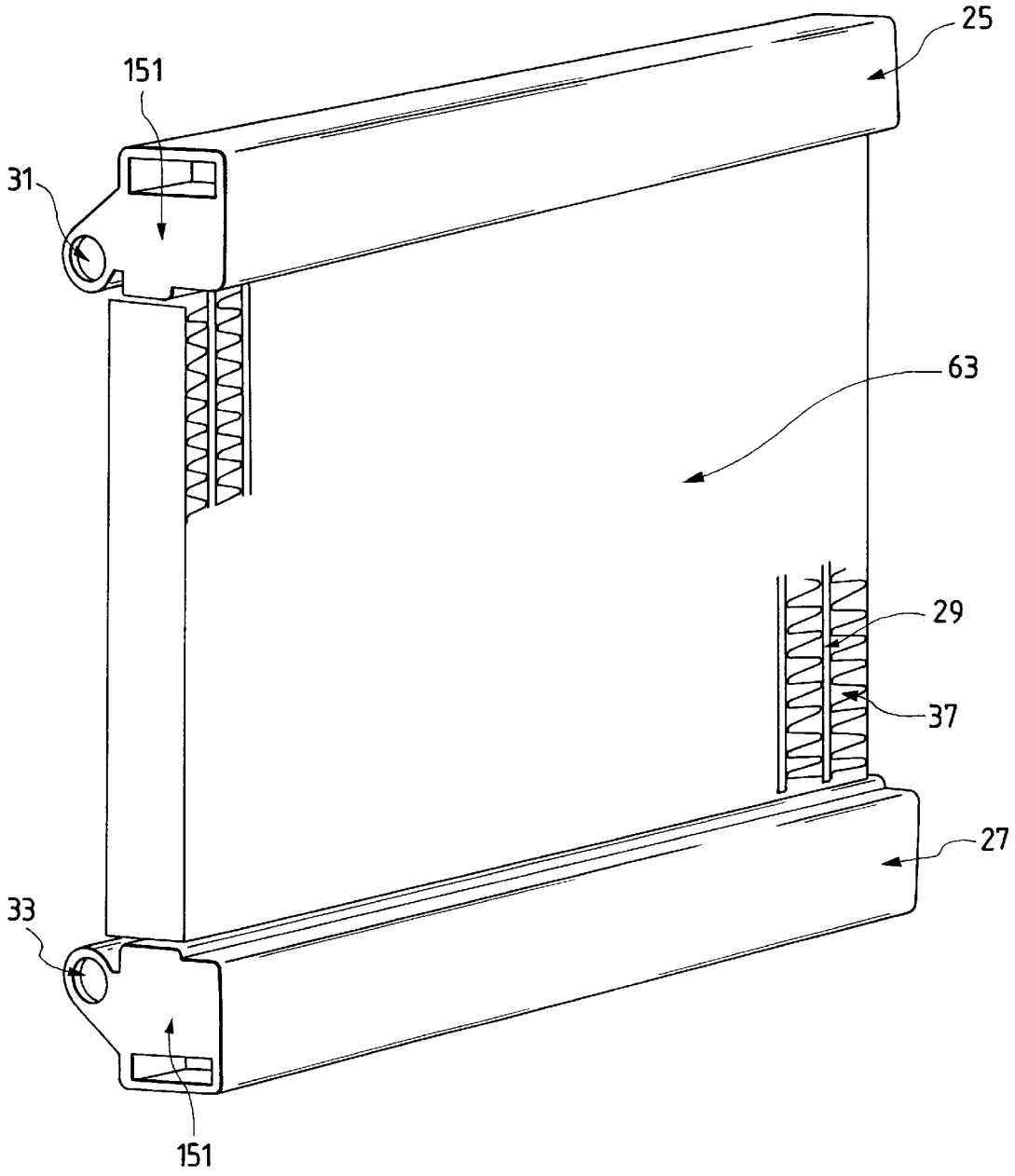
FIG. 8 is a perspective view illustrating the integral-type heat exchanger shown in FIG. 7.
Figure 9:
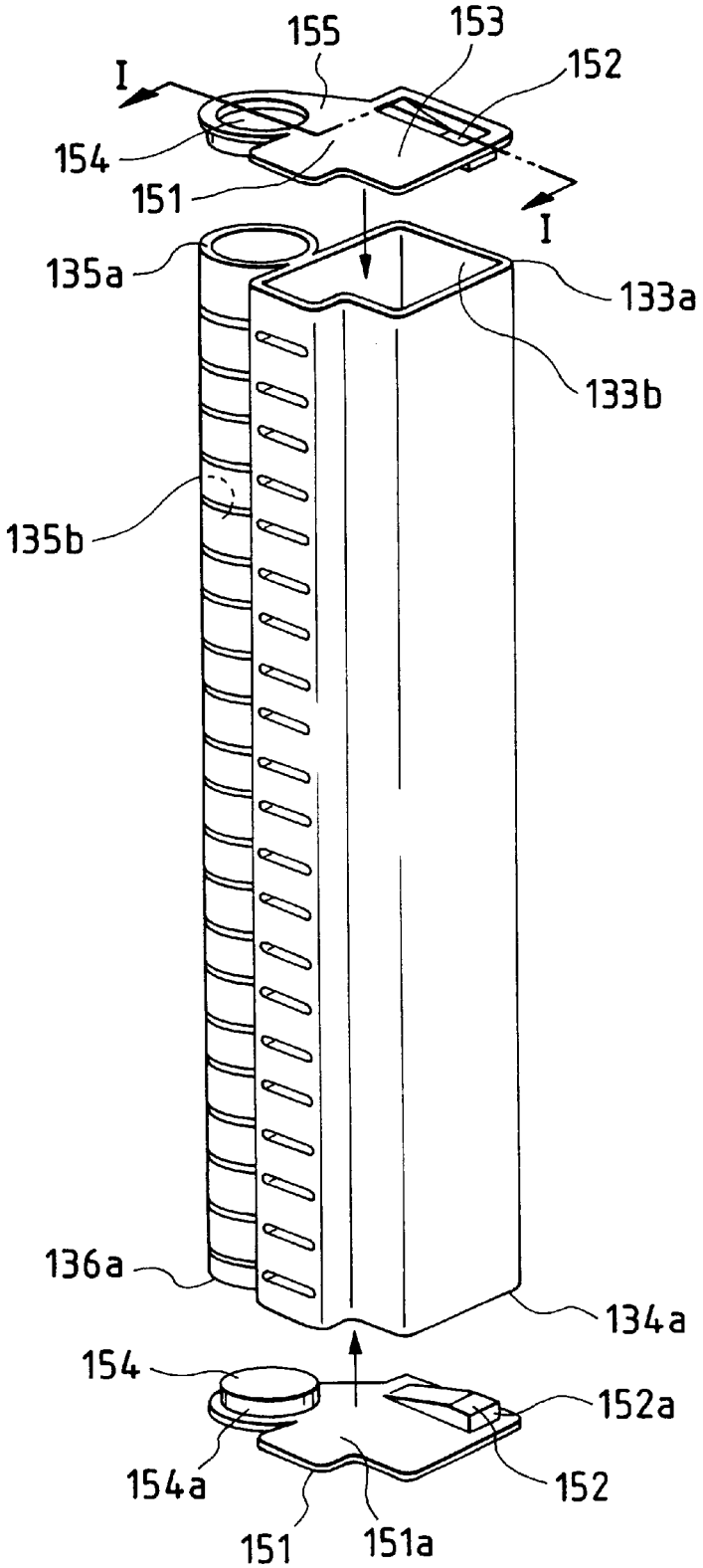
FIG. 9 is an exploded perspective view of the integral-type heat exchanger illustrated in FIG. 7 when they are attached to the tank.
Figure 10:
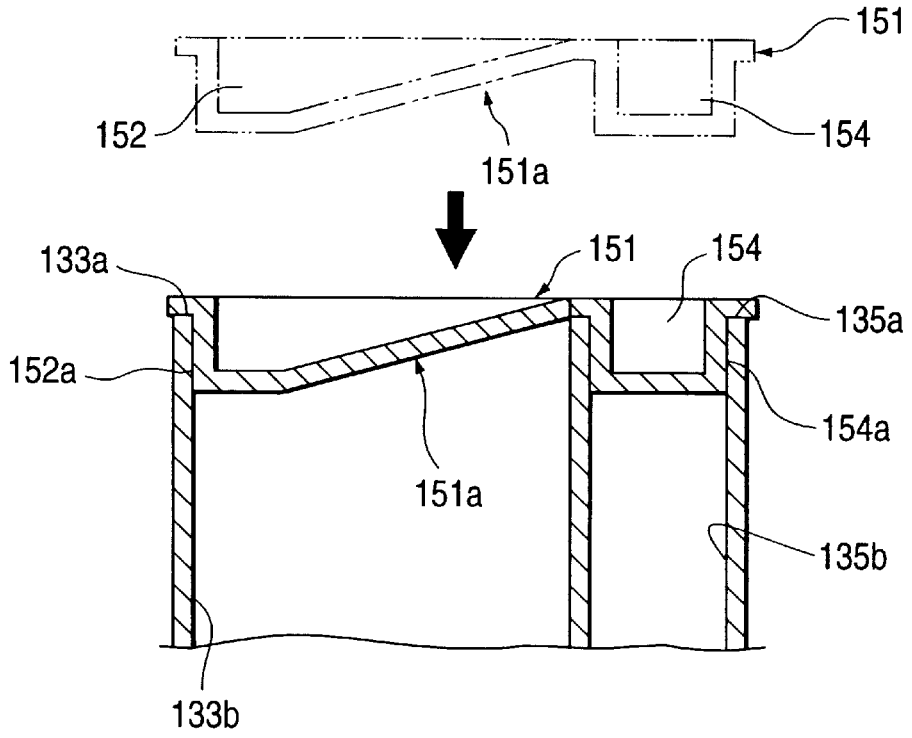
FIG. 10 is a cross sectional view of the principal elements of the end plate and the tank taken along line I—I illustrated in FIG. 9.

As illustrated in FIGS. 7, 9 and 10, end plates 151 made of brazing-material-clad aluminum (e.g., A4343-3003) are attached to open ends 133*a*, 134*a*, 135*a*, and 136*a* of the first and second heat exchanger tanks 25, 27, 31, and 33. The brazing material is positioned on the surface side facing the heat exchanger tanks. FIG. 8 shows a perspective view of integral-type heat exchanger tanks according to this embodiment.

Each end plate 151 is made from a single plate material which closes the first heat exchanger tanks 25, 27 and the second heat exchanger tanks 31, 33 at one time.

Rectangularly recessed lock members 152 which come into contact with inner walls 133*b* of the first heat exchanger tanks 25, 27 are formed in areas 153 which cover the first heat exchanger tanks 25, 27.

Circularly recessed lock members 154 which come into contact with entire inner wall surfaces 135*b* of the second heat exchanger tanks 31, 33 are formed in areas 155 which cover the second heat exchanger tanks 31, 33.

In the integral-type heat exchanger tank according to the present embodiment having the foregoing structure, as shown in FIGS. 9 and 10, the end plates 151 are attached to the open ends 133*a*, 134*a*, 135*a*, and 136*a* of the first and second heat exchanger tanks 25, 27, 31, and 33.

When the rectangularly-recessed lock members 152 are press-fitted with the inner walls 133*b* of the first heat exchanger tanks 25, 27, upright sides 152*a* are tightly fitted with the inner walls 133*b* of the first heat exchanger tanks 25, 27. Simultaneously, the circularly-recessed lock members 154 are press-fitted with the entire inner wall surfaces 135*b* of the second heat exchanger tanks 31, 33, and upright sides 154*a* are tightly fitted with the entire inner wall surfaces 135*b* of the second heat exchanger tanks 31, 33.

Further, since the upright sides 152*a* of the lock members 152 are tightly fitted with the inner wall surfaces 133*b* of the first heat exchanger tanks 25, 27, the end plates 151 are prevented from rotating around the lock members 154.

In the integral-type heat exchanger of the present embodiment having the foregoing structure, the first heat exchanger tanks 25, 27 and the second heat exchanger tanks 31, 33 are molded from aluminum by extrusion. When compared with an heat exchanger is made by the assembly of a plurality of part, the integral-type heat exchanger of the present embodiment is simple in structure and is free from faulty brazing.

As illustrated in FIG. 10 which is a cross sectional view taken along line I—I illustrated in FIG. 9, the end plates 151 made of brazing-material-clad aluminum are attached to open ends 133*a*, 134*a*, 135*a*, and 136*a* of the first and second heat exchanger tanks 25, 27, 31, and 33. The rectangularly-recessed lock members 152 are press-fitted with the inner wall surfaces 133*b* of the first heat exchanger tanks 25, 27. Simultaneously, the circularly-recessed lock members 154 are press-fitted with the entire wall surfaces 135*b* of the second heat exchanger tanks 31, 33. The inner walls 151*a* of the end plates 151 are brought into reliable contact with the entire open ends 133*a*, 134*a*, 135*a*, and 136*a* of the first and second heat exchanger tanks 25, 27, 31, and 33. As a result, the brazing material extends to every space at the time of brazing. The open ends 133*a*, 134*a*, 135*a*, and 136*a* of the first and second heat exchanger tanks 25, 27, 31, and 33 can be water-tightly closed.

Figure 11:
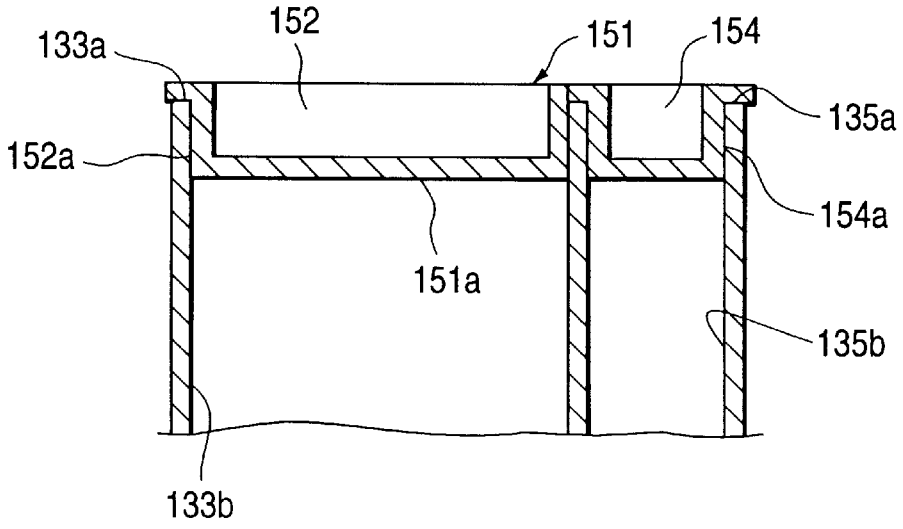
FIG. 11 is a cross sectional view of a modification of the integral-type heat exchanger tank illustrated in FIG. 7.

Although the present embodiment has been described with reference to the case where the upright side 152*a* of the lock member 152 of the end plate 151 is tightly fitted with one side of each of the inner wall surfaces 133*b* of the first heat exchanger tanks 25, 27, the lock member 152 may be formed into a recessed shape so that it can come into contact with the entire circumferential surface of each of the inner wall surfaces 133*b* of the first heat exchanger tanks 25, 27 as shown in FIG. 11.

Figure 12:
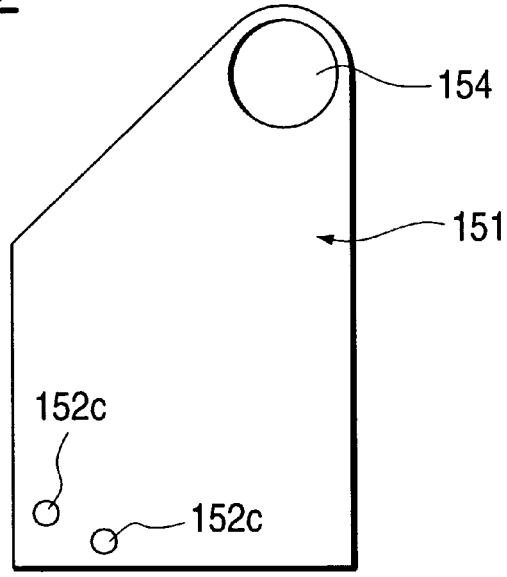
FIG. 12 is a sectional view of the modification of the integral-type heat exchanger tank illustrated in FIG. 7.

The lock members 152 of the end plates 151 may be formed into; e.g., protuberances 152*c*, as shown in FIG. 12, which come into contact with at least two sides of the inner walls 133*b* of the first heat exchanger tanks 25, 27, so long as they have locking and whirl-stopping functions. These protuberances are necessary to prevent the rotation of the end plates 151 about the lock members 154 which would otherwise be caused when only the lock members 154 are fitted into the circular second heat exchanger tanks 31, 33. Accordingly, various types of modifications of the lock members 152 are feasible, and the lock members 152 are not limited to any particular shape so long as they have locking and whirl-stopping functions.

3rd Embodiment

In a third embodiment of the present invention, as illustrated in FIGS. 13 to 16, two attachment slots 251, 252 are formed in the second heat exchanger tanks 31, 33 so as to extend up to the joint 61. Partitions 252 which have a substantial ohm-shaped geometry and comprise brazing-material-clad aluminum (e.g., A4343-3003-4343; the brazing material being positioned on the both surface of the partition 252) are fitted into the attachment slots 251.

The partition 252 comprises a closing plate 253 which has the same shape as that of the attachment slot 251, and a lock piece 254 to be locked into the joint 61 between the first and second heat exchanger tanks 25, 27, 31, and 33.

In the integral-type heat exchanger having the foregoing structure according to the embodiment, the partitions 252 are fitted into the attachment slots 251 formed so as to extend up to the joint 61, with the lock piece 254 being inserted first. When a front end 254*a* of the lock piece 254 has come into contact with the joint 61, the lock piece 254 is i1o bent, whereby the partitions 252 are attached to the second heat exchanger tanks.

Figure 17:
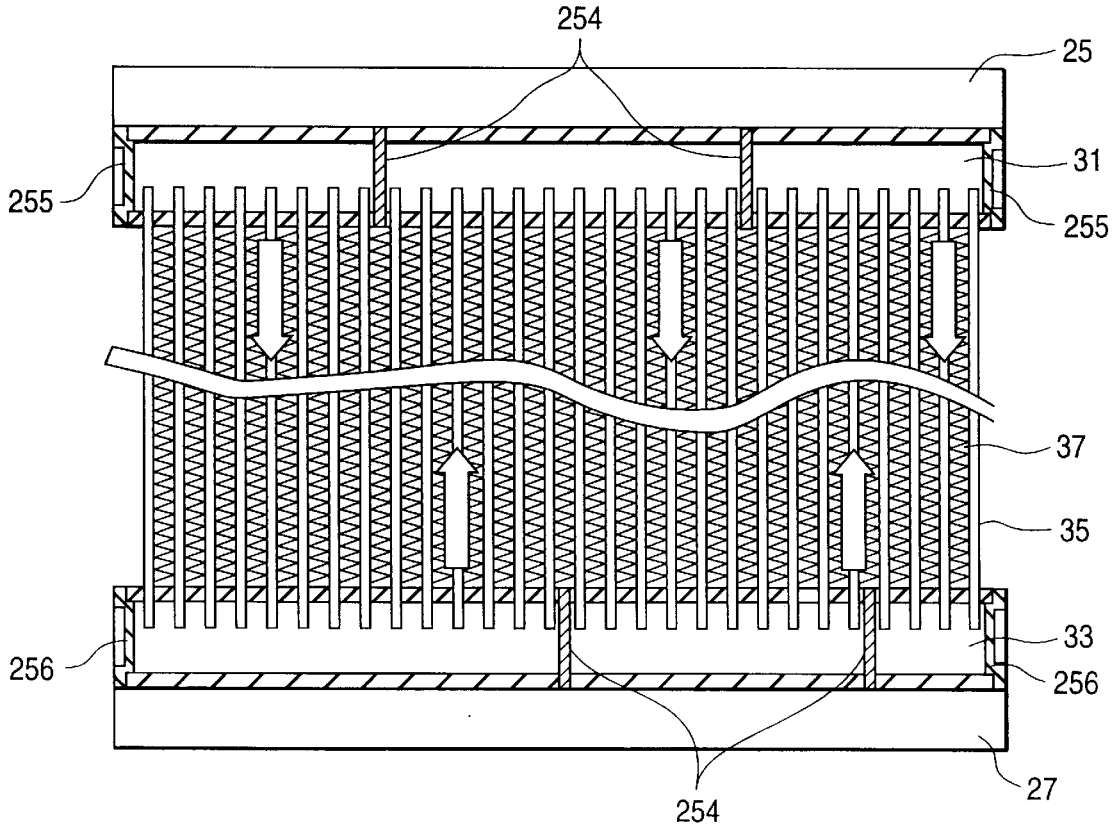
FIG. 17 is a schematic representation illustrating the direction in which a coolant circulates through second heat exchanger in the integral-type heat exchanger illustrated in FIG. 13.

As shown in FIG. 17, end plates 255, 256 made of brazing-material-clad aluminum (e.g., A4343-3003) are attached to both ends of the second heat exchanger tanks 31, 33.

Figure 13:
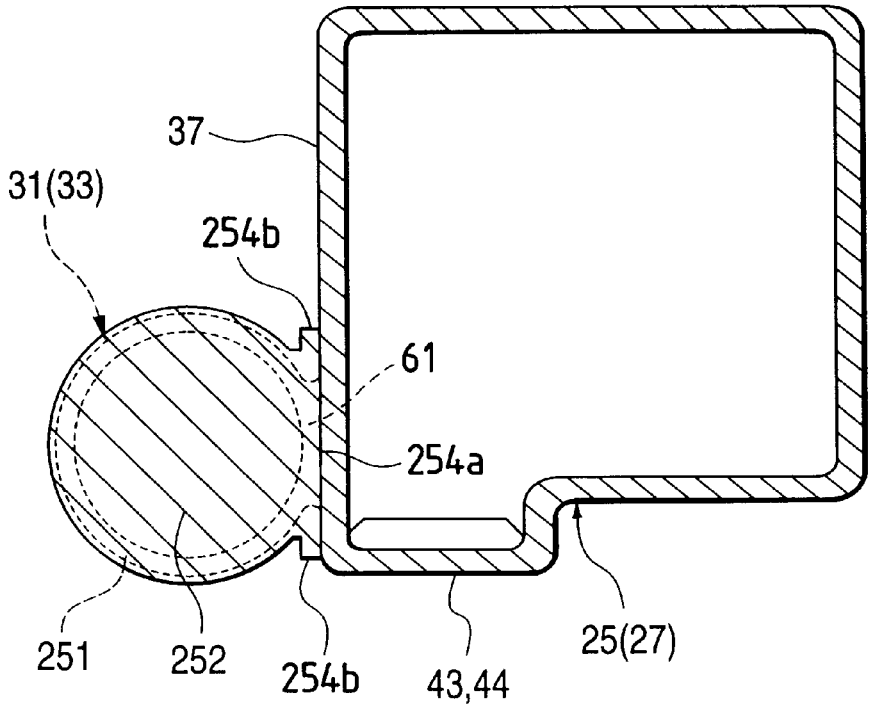
FIG. 13 is a cross sectional view illustrating a third embodiment of integral-type heat exchangers according to the present invention.
Figure 14:
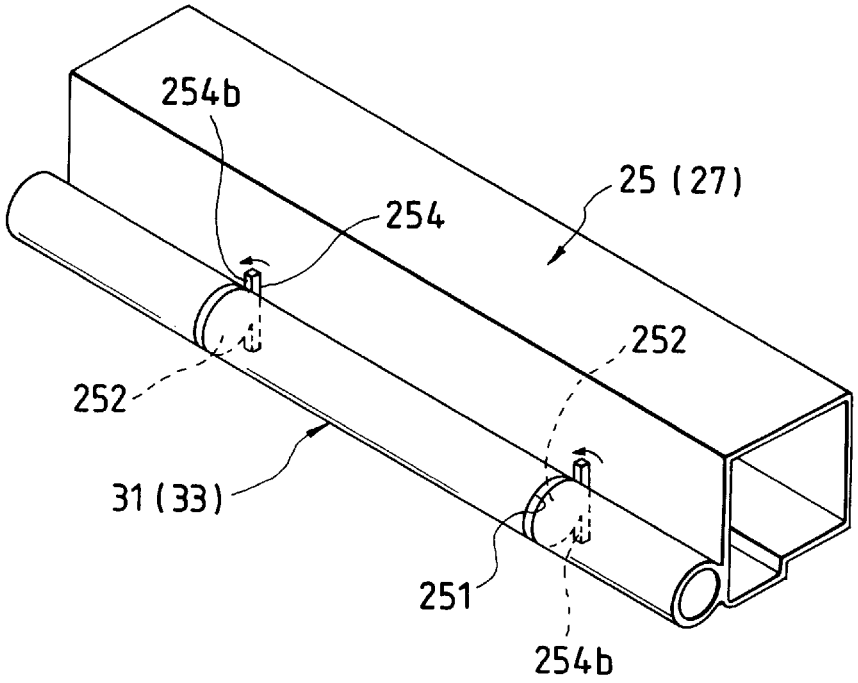
FIG. 14 is a perspective view of the heat exchanger tank illustrated in FIG. 13.
Figure 15:
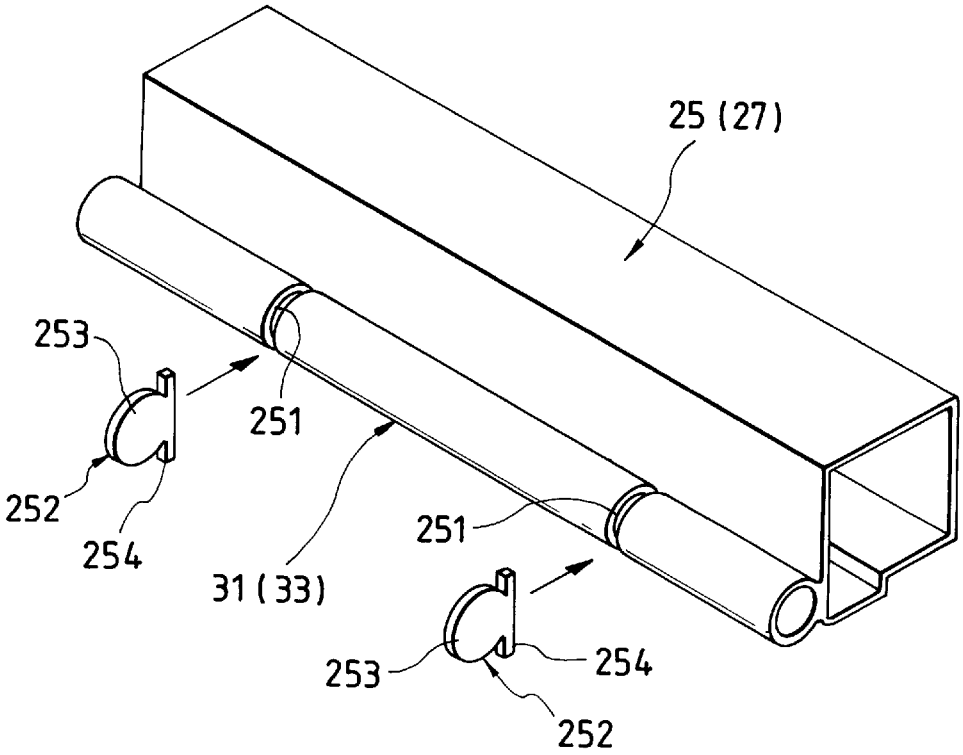
FIG. 15 is an exploded view of end plates illustrated in FIG. 13 when they are attached to the tank.
Figure 16:
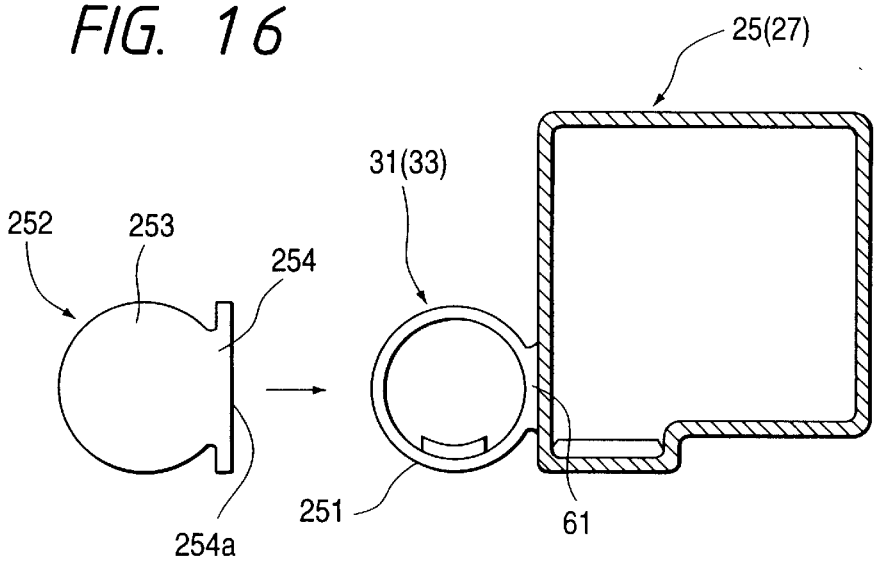
FIG. 16 is an enlarged cross sectional view of the integral-type heat exchanger tanks illustrated in FIG. 15.

As illustrated in FIGS. 13 and 14, the partitions 252 made of brazing-material-clad aluminum (e.g., A4343-3003-4343) are fitted into the attachment slots 251 formed so as to extend from the second heat exchange tanks 31, 33 to the joint 61. The lock pieces 254 are bent, and folded portions 254*b* of the lock pieces 254 of the partitions 252 are reliably held in the slots 251. As a result, the brazing material extends to every space at the time of brazing. The partitions 252 can be reliably water-tightly closed.

In this embodiment, as illustrated in FIG. 17, the two partitions 254 are attached to each of the second heat exchanger tanks 31, 33. Therefore, if the second heat exchanger tanks are used as a condenser, a coolant circulates in the direction indicated by an arrow.

Hereupon, the direction in which the coolant circulates can be changed by changing the number of the partitions 254 to be inserted into the second heat exchanger tanks 31, 33. Since the number of turns of the coolant can be increased by changing the number of partitions 254 as required, the cooling efficiency can be improved.

4th Embodiment

Figure 21:
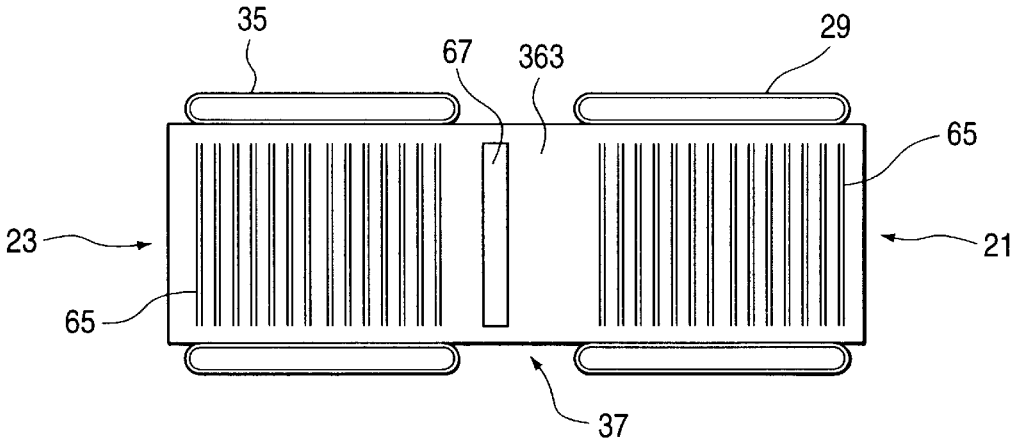
FIG. 21 is a plan view of a corrugated fin in a fourth embodiment of the integral-type heat exchanger according to the present invention.
Figure 22:
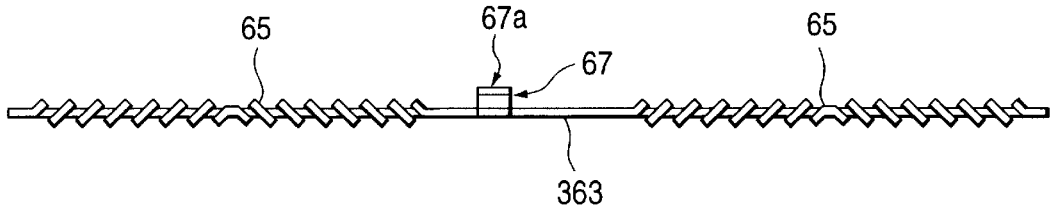
FIG. 22 is a cross sectional view of the corrugated fin shown in FIG. 21.
Figure 23:
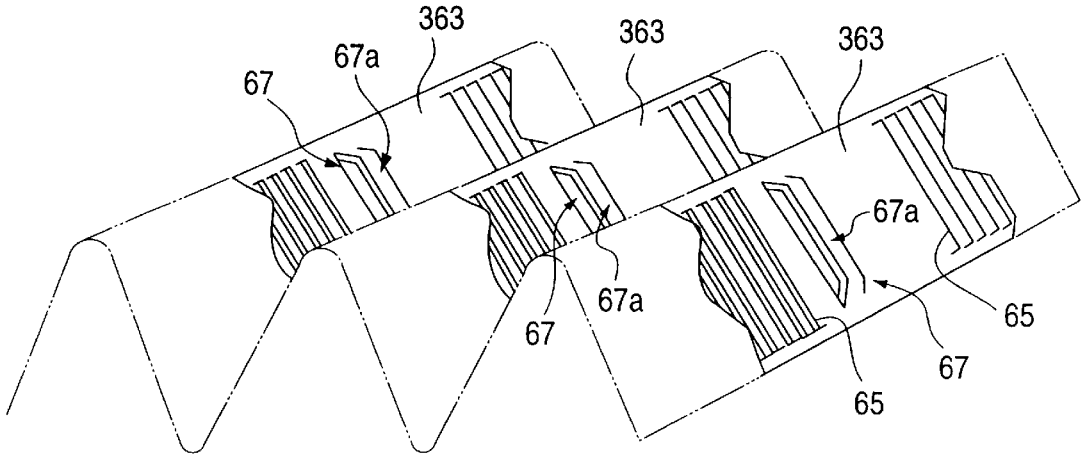
FIG. 23 is a perspective view of the corrugated fin shown in FIG. 21.

FIGS. 21 to 23 show a fourth embodiment of the integrated-type heat exchanger according to the present invention. The operating temperature of the first heat exchanger 21 is around 85 degrees centigrade, and the operating temperature of the second heat exchanger 23 is around 60 degrees centigrade. Accordingly, the first heat exchanger 21 will be explained as the heat exchanger having a high operating temperature in the embodiment.

In FIG. 21, the both upper and lower tanks are not shown.

The aluminum corrugated fin 37 having ordinary louvers 65 formed therein is integrally formed between the tubes 29 of the first heat exchanger 21 and the tubes 35 of the second heat exchanger 23. Parallel louvers 67 are formed in a joint portion 363 of the corrugated fin 37 between the tubes 29 of the first heat exchanger 21 and the tubes 35 of the second heat exchanger 23 so as to be positioned much closer to the second heat exchanger 23.

The parallel louvers 67 are formed in the joint portion 363 in such a manner that a part of the joint portion 363 is protruded upward, and a protruded top portion 67*a* is made parallel with the surface of the joint portion 363 as shown in FIG. 23.

According to the integral-type heat exchanger of the present embodiment having the foregoing structure, the heat transfer through the corrugated fin 37 from the first heat exchanger 21 having a high operating temperature to the second heat exchanger 23 having a lower operating temperature is effectively exchanged with air by the parallel louvers 67. As a result, a thermal influence is prevented from acting on the second heat exchanger 23 having a low operating temperature.

The wind passing through the tubes 29, 35 of both heat exchangers 21, 23 can flow in the direction of ventilation without increasing resistance of the parallel louvers 67.

Figure 42:
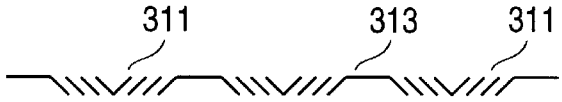
FIG. 42 RELATED ART
FIG. 42 is a cross sectional view of the corrugated fin in a conventional integral-type heat exchanger.

As described above, according to the present embodiment, the parallel louvers are formed so as to be closer to the second heat exchanger 23 having a low operating temperature as means for preventing thermal interference between the heat exchangers 21, 23 having different operating temperatures. As a result, the parallel louvers can reduce an increase in the ventilation resistance compared with conventional heat-transfer prevention louvers 313 which are formed in substantially the same geometry as ordinary louvers 311 as shown in FIG. 42, enabling prevention of a decrease in cooling performance of the heat exchanger. That is, the ordinary louvers 311 induce an increase in ventilation resistance, which may cause a reduction in cooling performance by the conventional heat-transfer prevention louvers 313.

Figure 43:
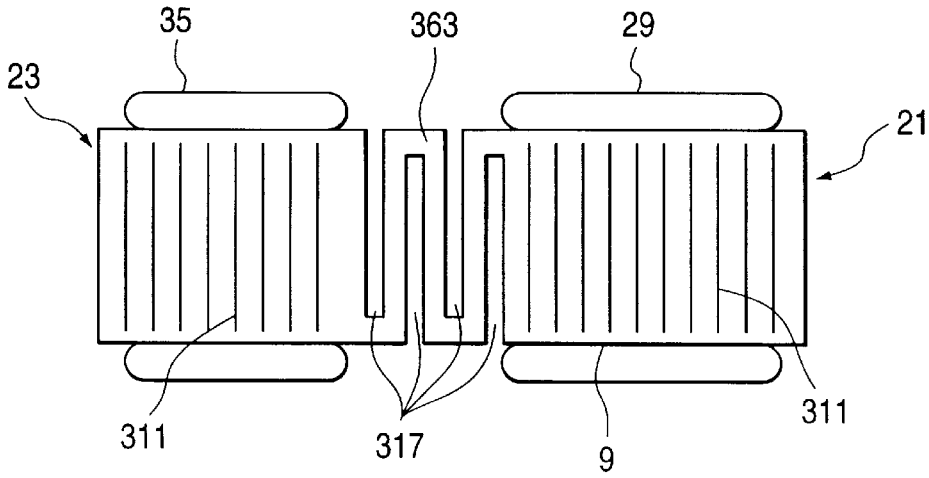
FIG. 43 RELATED ART
FIG. 43 is a plan view illustrating a conventional integral-type heat exchanger.

Further, the parallel louvers 67 and the ordinary louvers 65 can be machined at one time, which facilitates the machining of the fin and prevents occurrence of fragments. For example, in the integral-type heat exchanger shown in FIG. 43, heat-transfer prevention louver 313 are formed by a plurality of notches 317 so as to prevent the thermal interference between the heat exchangers 21, 23. However, fragments resulting from machining of the corrugated fin 65 in order to form the notches 317 block a cutter, thereby rendering the fin machining difficult. Further, the heat radiating area cannot be utilized.

Since no louvers are formed in the joint portion 363 except for the parallel louvers 67, the joint portion 363 can act as a head radiating section, resulting in an increase in the radiating area. Therefore, the function of the integral-type heat exchanger can deliver its performance sufficiently.

Although the parallel louvers 67 are formed in the vicinity of the second heat exchanger 23 having a low operating temperature in the previous embodiment, they can deliver superior heat radiating performance compared with the conventional heat-transfer prevention louvers having one through a plurality of cutouts, so long as the parallel louvers are formed between the first heat exchanger 21 having a high operating temperature and the second heat exchanger 23 having a low operating temperature.

5th Embodiment

Figure 24:
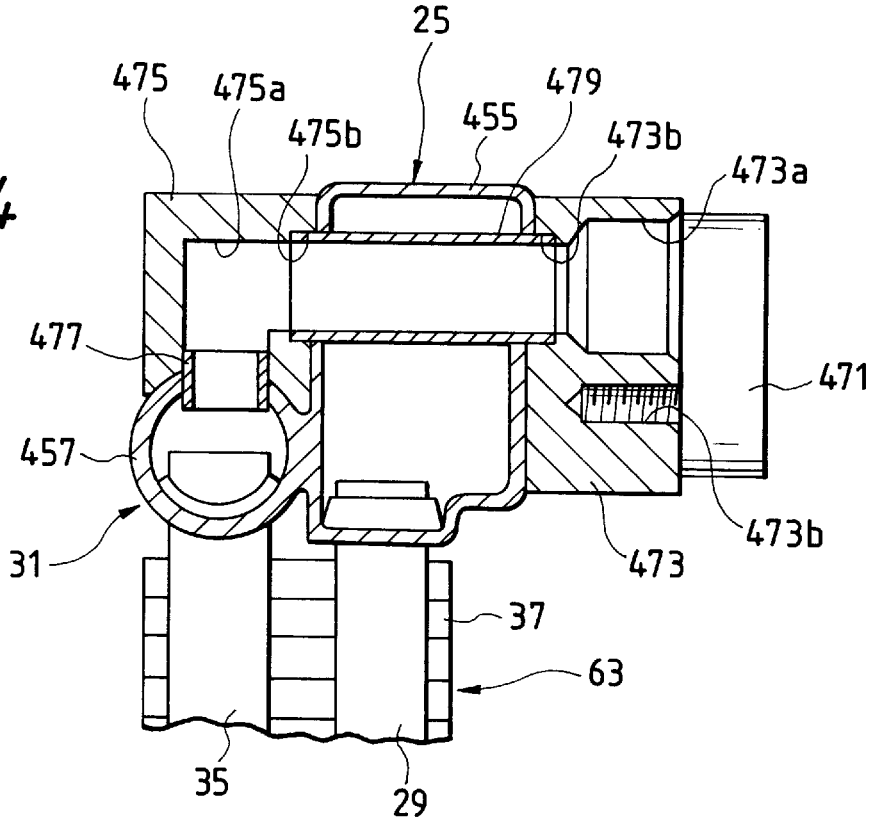
FIG. 24 is a cross sectional view of an integral-type heat exchanger tank according to a fifth embodiment of the present invention.
Figure 25:
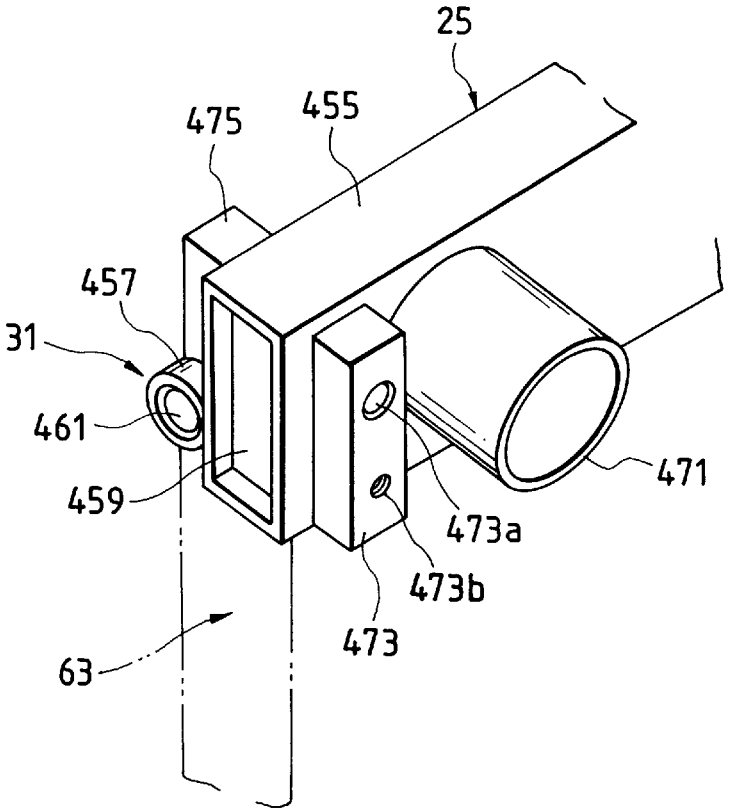
FIG. 25 is a perspective view illustrating the integral-type heat exchanger tank shown in FIG. 24.

FIGS. 24 to 27 show a fifth embodiment of the integrated-type heat exchanger according to the present invention, especially, the tanks 25 and 31 of the first and second heat exchangers are integrated. As illustrated in FIG. 24, the ends of aluminum-material-clad first and second tubes 29 and 35 are fitted into the first and second tank bodies 455 and 457. Further, as illustrated in FIG. 25, the edges of the first and second tank bodies 455 and 457 are closed by aluminum-material-clad end plates 459, 461.

Piping sections 471 for inflow or outflow purposes, which will be described later, are formed and opened in the surface of the first tank body 455 which is opposite to the second tank body 457.

First aluminum connectors 473 are bonded to the surface of the first tank body 455 so as to be positioned outwards next to the piping sections 471 by brazing.

The first connectors 473 have a rectangular geometry, and connection holes 473*a* are formed in the first connectors 473 through which inlet/outlet pipes are connected to the second tank body 457, as will be described later.

A screw hole 473*b* for fixing a piping bracket is formed in each first connector 473 so as to be spaced a distance way from the connection hole 473*a*.

Second aluminum connectors 475 are bonded to the side surface of the first tank body 455 facing the second tank body 457 so as to be in an opposite relationship relative to the first connectors 473 by brazing.

L-shaped connection holes 475*a* are formed in the second connector 475 and are connected at one end to the first tank body 457 through the connection pipe 477.

An aluminum-clad pipe 479 is provided so as to penetrate through the first tank body 455.

The pipe 479 is connected at one end to the connection hole 473*b* of the first connector 473 and is connected at the other end to a communication hole 475*b* of the second connector 475 by brazing.

Figure 26:
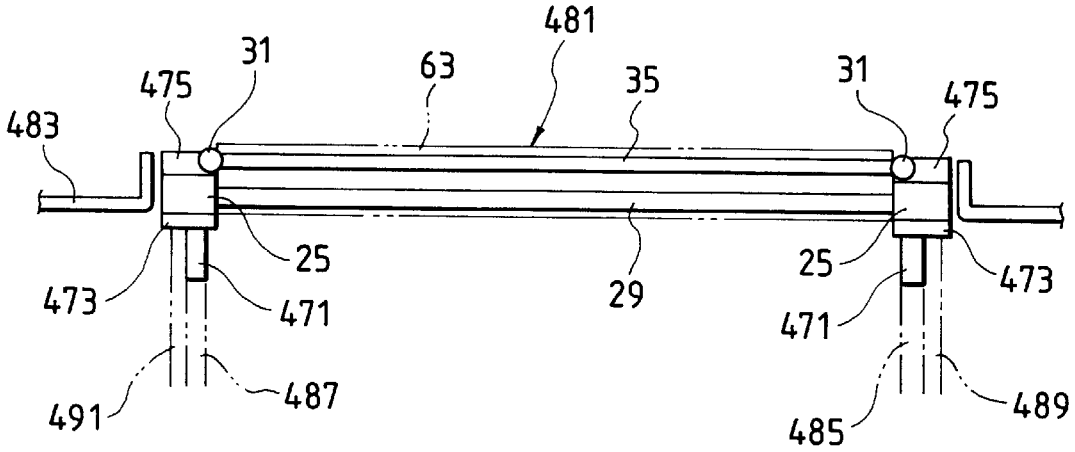
FIG. 26 is an explanatory view illustrating an integral-type heat exchanger which employs the integral-type heat exchanger tank shown in FIG. 24 when it is attached to a radiator core panel of an automobile.

FIG. 26 illustrates an integral-type heat exchanger 481 which employs the previously-described integral-type heat exchanger tank and is attached to a radiator core panel 483 of an automobile. An inlet pipe 485 for inflow of coolant and an outlet pipe 487 for outflow of the coolant are connected to the piping sections 471 of the first heat exchanger tank 25.

An inlet pipe 489 for inflow of coolant and an outlet pipe 491 for outflow of the coolant are connected to the first connector 473 of the second heat exchanger tank 31.

Figure 44:
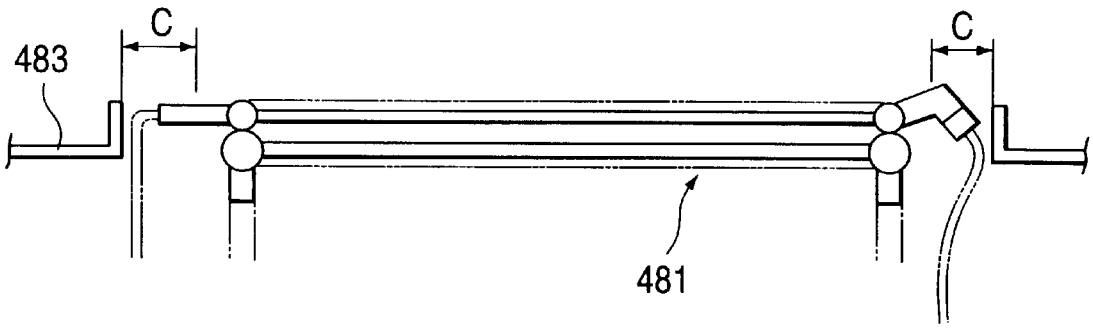
FIG. 44 RELATED ART
FIG. 44 is an explanatory view illustrating a conventional integral-type heat exchanger when it is attached to a radiator core panel of an automobile.

In the integral-type heat exchanger tank having the foregoing structure, the first connectors 473 are formed on the side surface of the first heat exchanger tank 25 opposite to the second heat exchanger tank 31. The first connectors 473 are connected to the second heat exchanger tank 31 through the pipe 479, penetrating through the first heat exchanger tank 25, as well as through the second connectors 475. The inlet/outlet pipes 489, 491 which permit inflow/outflow of the coolant to the second heat exchanger tank 25 are connected to the first connectors 473. As a result, the pipes can be easily and reliably connected to the second heat exchanger tank without the projection of the connectors of the second heat exchanger tank outside which is situated in front of the first heat exchanger tank as was in the case with the conventional heat exchanger tank illustrated in FIG. 44. In FIG. 44, a comparatively large clearance C is formed between the radiator core panel 483 and the integral heat exchanger 481. The cooling performance of the heat exchanger is reduced due to the leakage of wind caused by the forward motion of a car drift caused by the radiator fan.

As illustrated in FIG. 26, the connectors do not project outside from the second heat exchanger tank as was the case with the conventional heat exchanger tank, and hence the area of the core 63 can be increased, and the efficiency of heat exchange can be improved, provided that the open area of the radiator core panel 483 is constant.

A clearance between the integral-type heat exchanger 481 and the radiator core panel 483 can be reduced, thereby ensuring a predetermined cooling performance without sealing the clearance with urethane materials.

Further, the pipes 485, 487, 489, and 491 can be connected to the first and second heat exchanger tanks 25 and 31 from the side of the first heat exchanger tank 31 opposite to the second heat exchanger tank 31. Therefore, the man-hours required for connection of the pipes 485, 487, 489, and 491 can be significantly reduced relative to those required for connection of pipes of the conventional heat exchanger tanks.

In the previously-described integral-type heat exchanger tanks, second connectors 475 communicating with the second heat exchanger tank 31 are provided on the side surface of the first heat exchanger tank 25 facing the second heat exchanger tank 31. The pipe 479 penetrating through the first heat exchanger tank 25 is connected to the second connectors 475. As a result, the pipe 479 can be easily and reliably connected to the second heat exchange tank 31.

Figure 27:
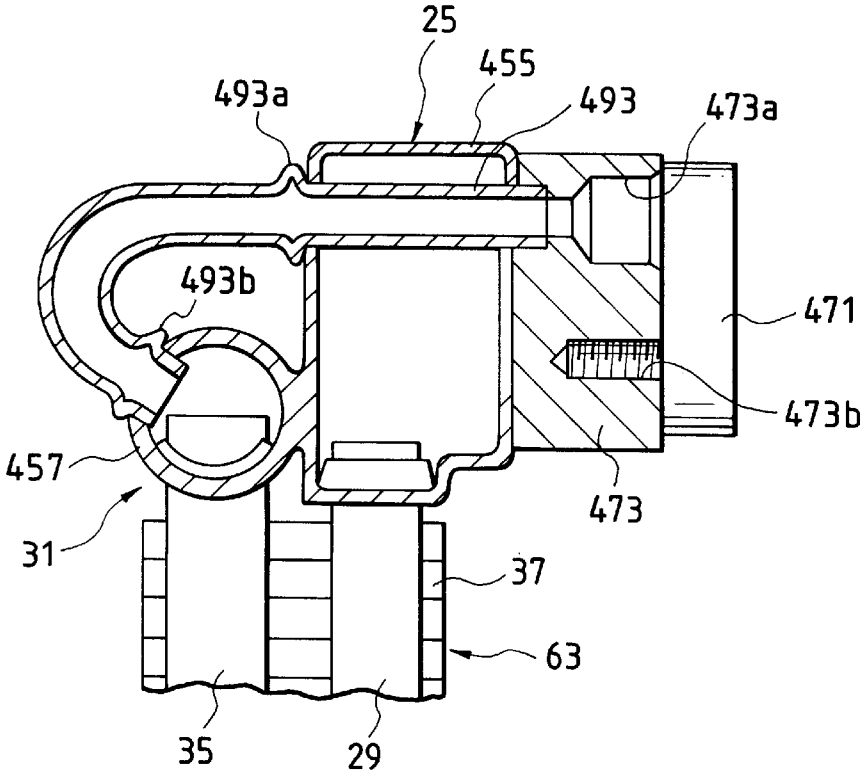
FIG. 27 is a cross sectional view illustrating of a modification of an integral-type heat exchanger tank in FIG. 24.

FIG. 27 illustrates another embodiment of the integral-type heat exchanger tank of the present invention. In this embodiment, a pipe 493 penetrating through the first tank body 455 of the first heat exchanger tank 25 is extended so as to be directly connected with the second tank body 457 of the second heat exchanger tank 31.

Beads 493*a*, 493*b* formed on the pipe 493 are connected to the side surface of the first tank body 455 and the outer circumferential surface of the second tank body 457 in a sealing manner by brazing.

The integral-type heat exchanger tank of this embodiment can produce the same effects as those obtained in the aforementioned embodiment. In this embodiment, the pipe 493 penetrating through the first tank body 455 is extended so as to be directly connected to the second tank body 457, enabling elimination of the necessity of the second connector 475.

Although the explanation has been given of the integral-type heat exchanger tank comprising a radiator and a condenser in the previous embodiments, the present invention is not limited to these embodiments. For example, the present invention can be applied to an integral-type heat exchanger tank comprising a radiator and an oil cooler.

6th Embodiment

Figure 28:
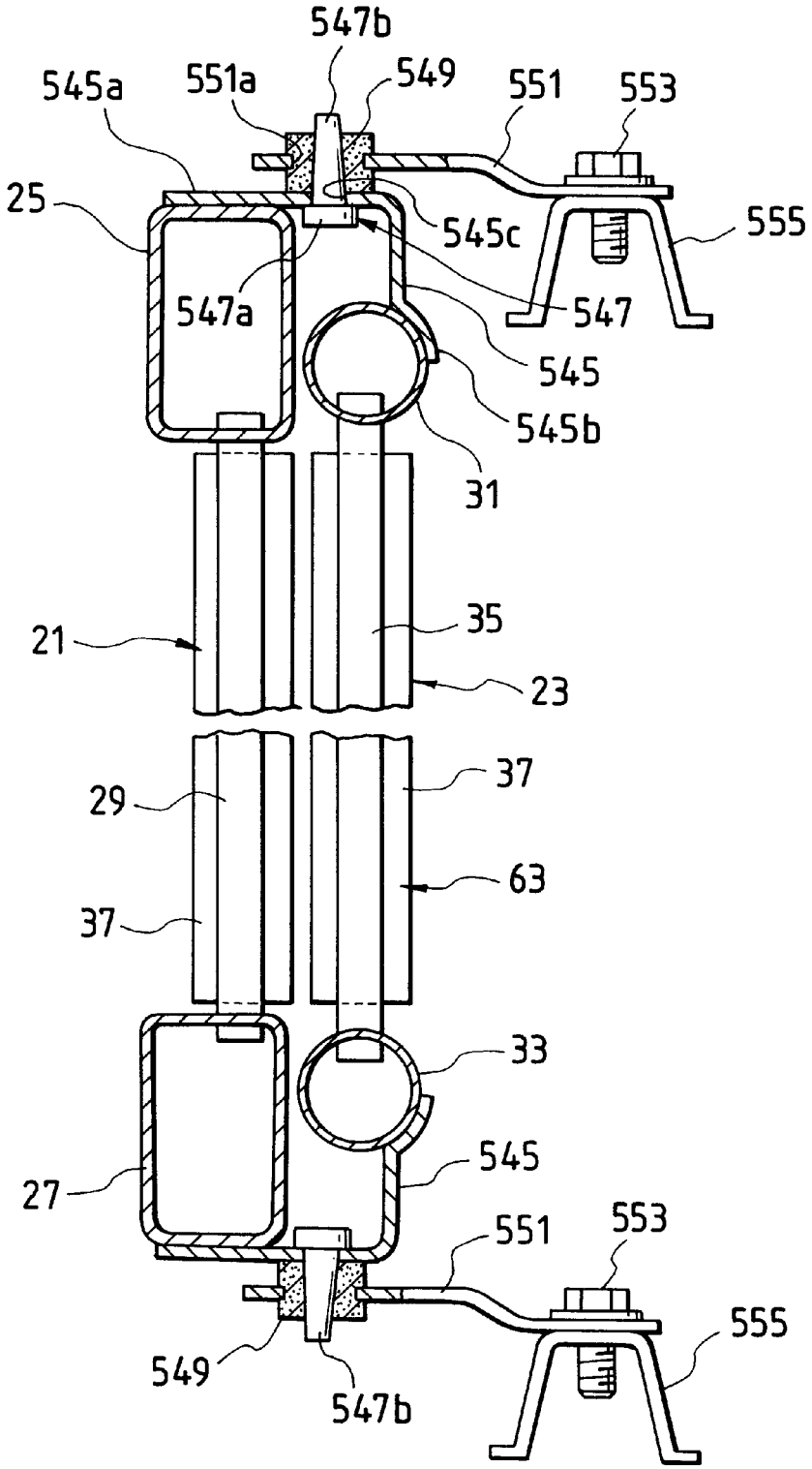
FIG. 28 is a cross sectional view illustrating an integral-type heat exchanger according to a sixth embodiment of the present invention.
Figure 29:
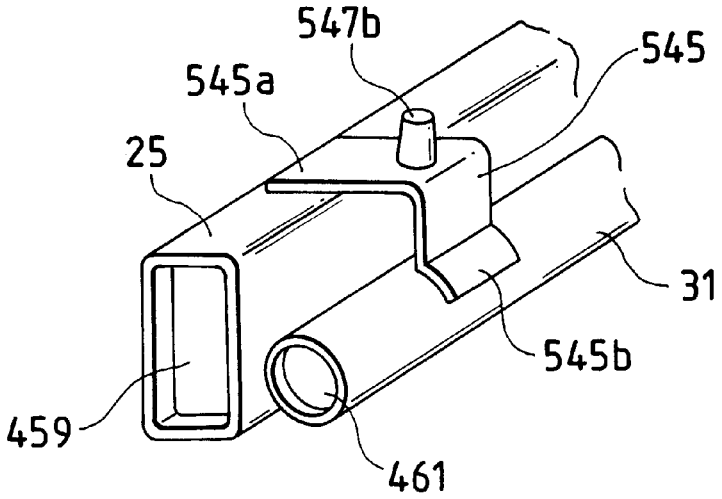
FIG. 29 is a perspective view illustrating upper part of the integral-type heat exchanger illustrated in FIG. 28.
Figure 30:
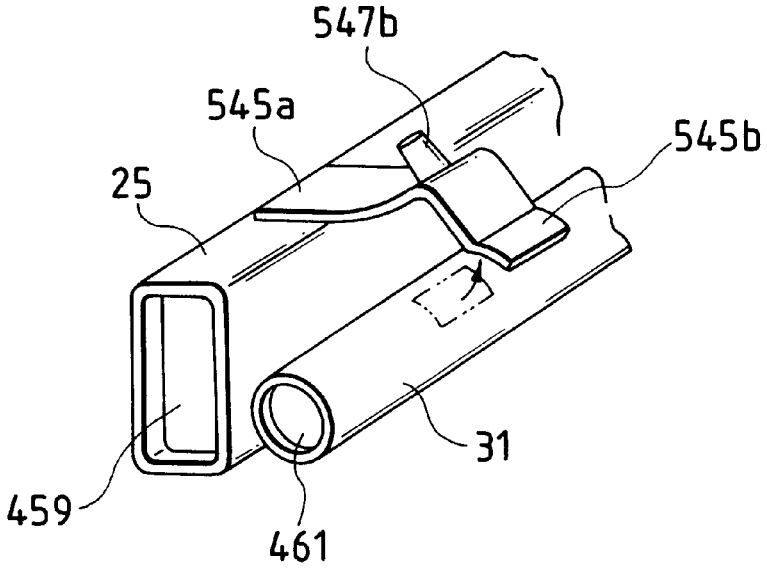
FIG. 30 is a perspective view illustrating the integral-type heat exchanger illustrated in FIG. 29 while joint members are removed from the heat exchanger.

FIGS. 28 to 30 show a sixth embodiment of the integrated-type heat exchanger according to the present invention.

In this embodiment, the first and second upper tanks 25 and 31 are connected together by the joint member 545, and the first and second lower tanks 27 and 31 are connected together by the joint member 545.

Further, in this embodiment, the fin 37 is not common to the first and second tubes 29 and 35 as described in the aforementioned embodiments. That is, the fin 37 is separated between the first and second heat exchangers 21 and 23, so that each first and second heat exchanger 21, 23 has the separated fin 37, 37. Of course, it is possible to apply the fin 37 spreading across the first and second tubes 29 and 35 as described in the aforementioned embodiments to this embodiment.

The joint members 545 are formed from a long plate material by folding, and hence each joint member 545 is formed to have on one side a portion 545*a* and have one the other side a portion 545*b*.

A through hole 545*c* is formed between the portions 545*a* and 45*b* of each joint member 545.

An aluminum pin 547 having a head 547*a* is fitted into the through hole 545*c*, thereby forming a projection 547*b*.

The joint member 545 is made of aluminum clad material, and a brazing layer is formed on the side of the joint member 545 facing the tank.

The joint member 545 is connected on both sides to the first and second upper tanks 25 and 31 by brazing, and the joint member 545 is also connected on both sides to the first and second lower tanks 27 and 33.

The inner side of the head 547*a* of the pin 547 is connected to the joint member 545 by brazing.

As illustrated in FIG. 28, the projection 547*b* of the joint member 545 is inserted into and supported by a through hole 551*a* formed in one side of a mount bracket 551 via mount rubber 549.

The other side of the mount bracket 551 is fixed to a rail 555 formed on the car body by a bolt 553.

In the foregoing integral-type heat exchanger, for example, if a collision force acts on the projections 547*b* of the joint members 545 in the even of a slight automobile collision, the collision force is divided between the first and second upper tanks 25, 31 or between the first and second lower tanks 27, 33 via the joint member 545, whereby the collision force is received by the first and second upper tanks 25, 31 or by the first and second lower tanks 27, 33.

For example, as shown in FIG. 30, if there is a large collision force, the portion 545*b* of the joint member 545 is exfoliated from the second upper tank 31, because the portion 545*b* has a small brazed area.

In the integral-type heat exchanger having the foregoing arrangement, the first upper tank 25 is connected to the second upper tank 31 by the joint member 545, and the upper projection 547*b* is formed between the portions 545*a*, 545*b* so as to be directed upwards. The collision force is divided between the first and second upper tanks 25, 31 via the joint member 545, thereby realizing ensured prevention of cracks in the upper tanks 25, 31.

Figure 45:
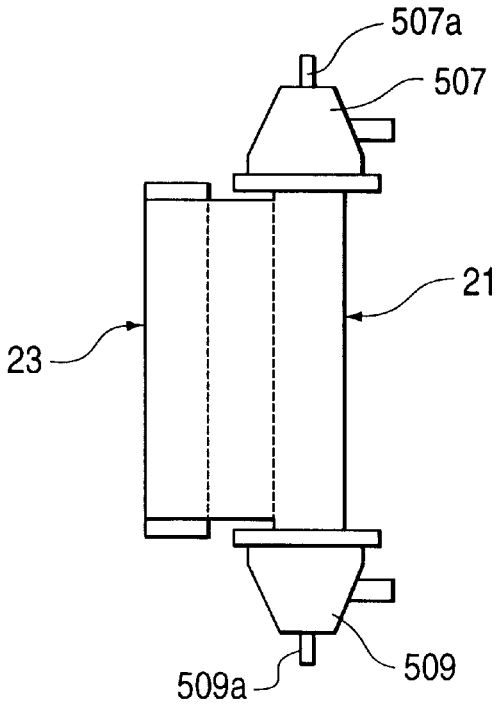
FIG. 45 RELATED ART
FIG. 45 is a side view illustrating a conventional integral-type heat exchanger.

Further, for example, in the conventional integral-type heat exchanger, the projections 507*a*, 509*a* used for mounting the integral-type heat exchanger to the car body are integrally formed with the upper and lower plastic tanks 507, 509 as shown in FIG. 45. In the event of a slight automobile collision, a collision force acts on the roots of the projections 507*a*, 509*a*, and clacks arise in the upper or lower tank 507 or 509 in the vicinity of the root of the projection 507*a*, 509*a*. There is a risk of leakage of cooling water from these cracks.

Since the upper projection 547*b* is formed between the portions 545*a*, 545*b* so as to be directed upwards, it is possible to reliably prevent the leakage of a fluid to the outside from the tanks 25, 31 even if cracks arise in the vicinity of the projections 547*b* of the joint members 545 resulting from a collision force acting on the projections 547*b*.

In the foregoing integral-type heat exchanger, the first upper tank 25, the second upper tank 31, and the joint members 545 are made of aluminum, and the joint member 545 is connected at respective ends connected to the first upper tank 25 and the second upper tank 31 by brazing. As a result, the joint member 545 can be easily and reliably connected to the tanks.

In the present embodiment, the first and second lower tanks 27, 33 are connected together by the joint member 545, there can be presented the same effect as that is obtained in the case where the first and second upper tanks 25 and 31 are connected together by the joint member 545.

7th Embodiment

Figure 31:
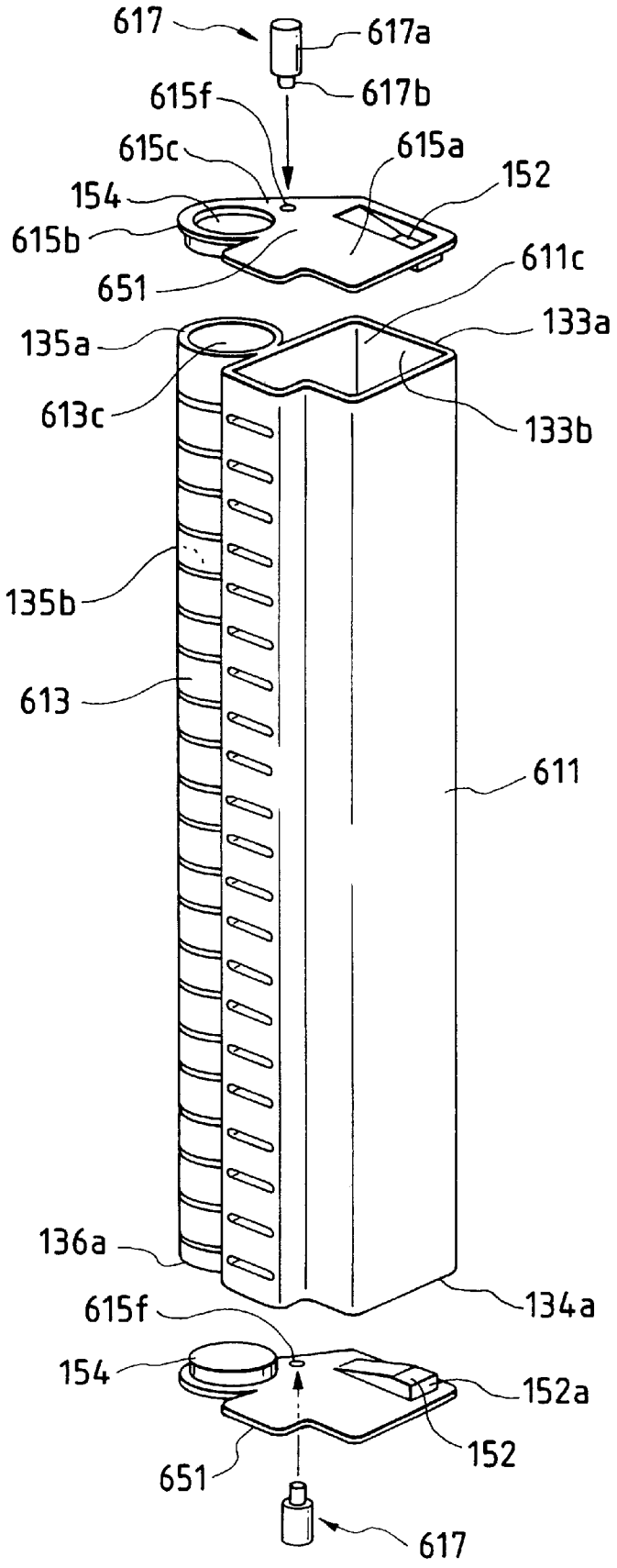
FIG. 31 is an exploded perspective view illustrating a seventh embodiment of an integral-type heat exchanger tank of the present invention.
Figure 32:
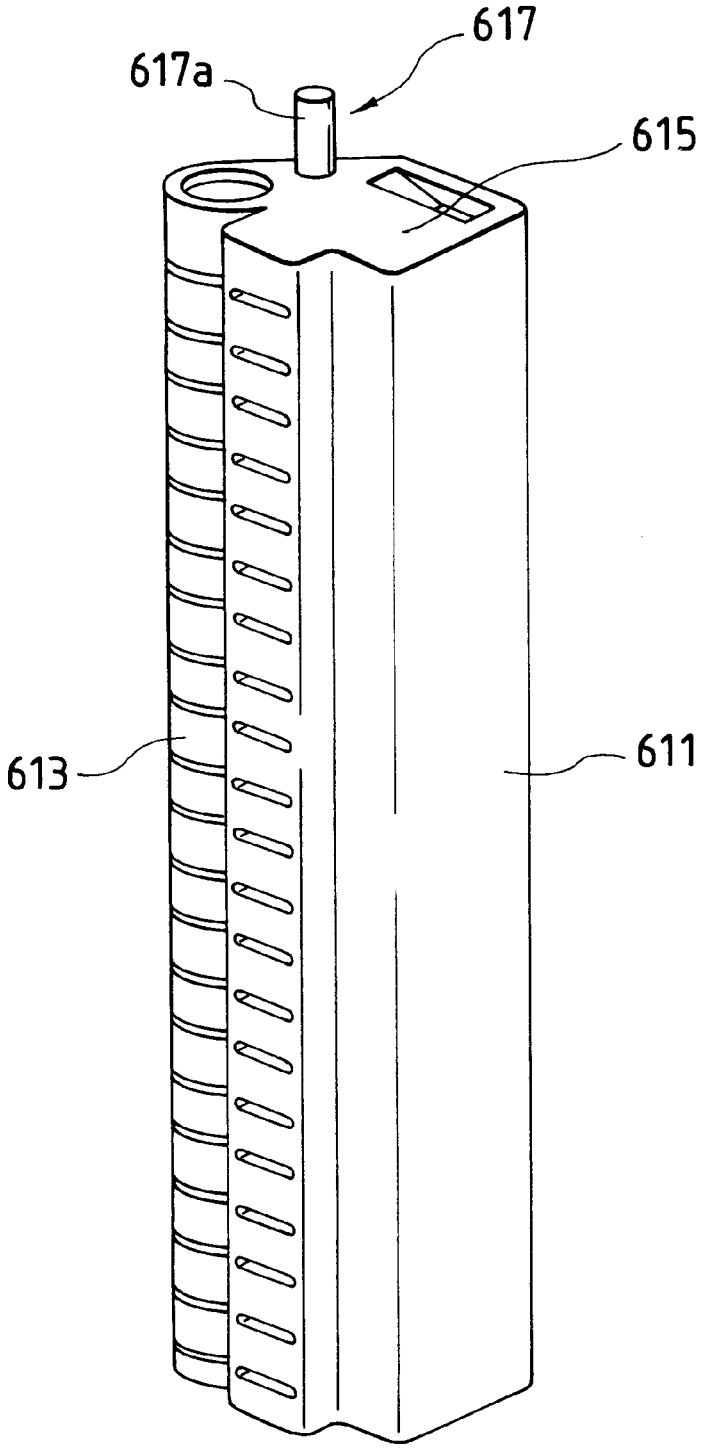
FIG. 32 is a perspective view of the integral-type heat exchanger tank illustrated in FIG. 31.

FIGS. 31 and 32 show a seventh embodiment of the integrated-type heat exchanger according to the present invention.

In the present embodiment, each end plate 615 has of a first area 615*a* for closing the first opening 611*c* and a second area 615*b* for closing the second closing 613*c*. A third area 615*c* is further formed in the end plate 615 outside relative to the first and second areas 615*a* and 615*b*.

A mounting section 617*a* used for mounting the integral-type heat exchanger tank to the car body is projectingly formed in the area of the third area 615*c* dislocated from the first and second openings 611*c* and 613*c*.

This mounting section 617*a* is formed by fitting a protuberance 617*b* of a pin 617 into a mounting hole 615*f* formed in the third area 615*c* by brazing.

This mounting sections 617*a* are supported by a mounting bracket provided on the car body via mount rubber.

The end plates 615 are temporarily fitted to the first and second openings 611*c* and 613*c* formed at the ends of the first and second tank bodies 611 and 613 via a brazing-material piece. While the protuberances 617*b* of the pins 617 are press-fitted into the mounting holes 615*f* of the end plates 615, the previously-described integral-type heat exchanger tank is integrally attached to an unillustrated core by brazing.

In the integral-type heat exchanger tank having the foregoing structure, the mounting sections 617*a* for mounting the integral-type heat exchanger tank to the body of a car are projectingly formed outside the areas of end plates 615 corresponding to first and second openings 611*c* and 613*c*. As a result, prevention of leakage of a fluid outside from the first tank body 11 through the mounting sections 617*a* can be ensured.

Further, in the previously-described integral-type heat exchanger tank, the protuberances 617*b* of the pins 617 are fitted into mounting holes 615*f* formed in the end plates 615 by brazing. Since the mounting holes 615*a* are formed outside the area of the end plates 615 corresponding to the first and second openings 611*c* and 613*c*. Therefore, even if there are faulty connection of the pins 617 to the mounting holes 615*f* due to faulty brazing, prevention of the leakage of a fluid stored in the first tank body 611 to the outside through the mounting sections 617*a* can be ensured.

8th Embodiment

Figure 33:
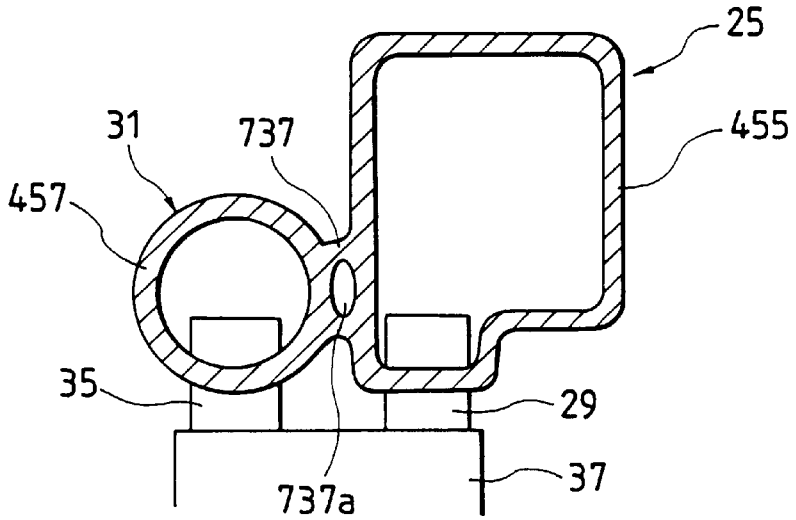
FIG. 33 is a cross sectional view illustrating an integral-type heat exchanger tank according to an eighth embodiment of the present invention.
Figure 34:
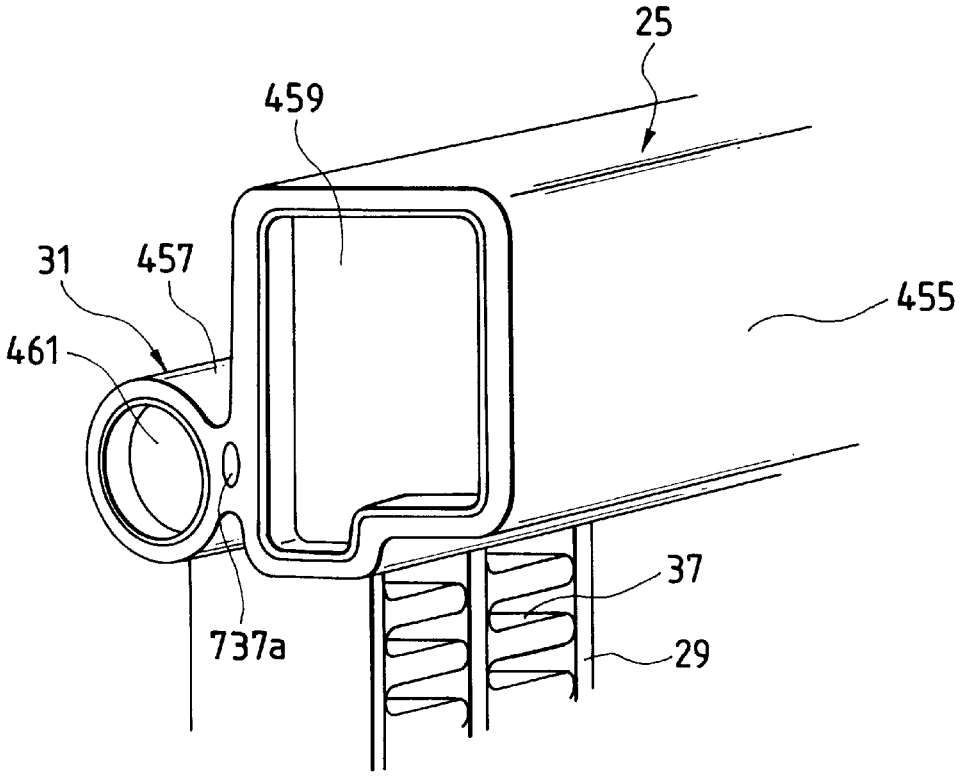
FIG. 34 is a perspective view illustrating the integral-type heat exchanger tank shown in FIG. 33.
Figure 35:
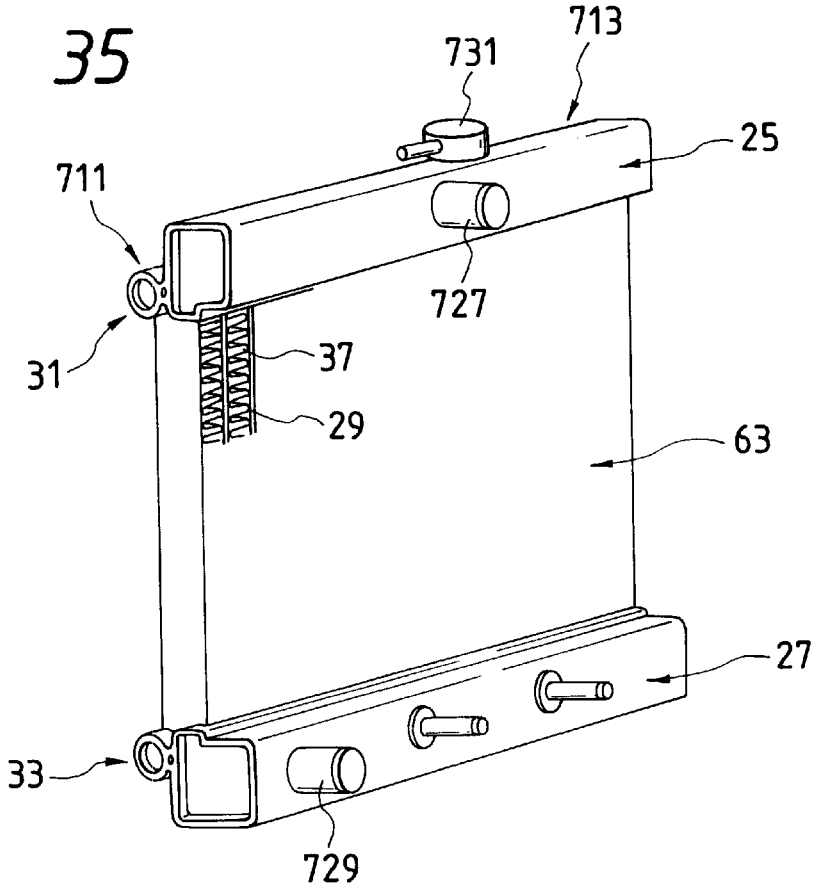
FIG. 35 is a perspective view illustrating the integral-type heat exchanger tank shown in FIG. 33.

FIGS. 33 to 35 show an eighth embodiment of the integrated-type heat exchanger according to the present invention. In the integral-type heat exchanger illustrated in FIG. 35, a condenser 711 is provided on the front face of a radiator 713.

Reference numerals 727, 729 in FIG. 35 designate inlet and outlet pipes, respectively. Reference numeral 731 designates a radiator cap.

The first and second tank bodies 455 and 457 are integrally formed with each other via a partition wall 737 between them.

In the present embodiment, a through hole 737*a* having an oval cross section is formed along the partition wall 737 and serves as a heat insulation space.

In the integral-type heat exchanger tank having the foregoing structure, the through hole 737*a* which serves as a heat insulation space is formed along the partition wall 737 through which the first and second tank bodies 455 and 457 are integrally formed with each other. Coolant circulating through the first tank body 455 and cooling water circulating through the second tank body 457 can reduce the thermal influence exerted on each other.

That is, in the conventional integral-type heat exchanger tank, the first tank body for use with the radiator and the second tank body for use with the condenser are formed integrally with each other with the partition wall (joint) between them. Therefore, heat of cooling water which has a comparatively high temperature and circulates through the first tank body for use with the radiator is transmitted via the partition wall to coolant which has a comparatively low temperature and circulates through the second tank body for use with the condenser, thereby impairing the cooling performance of the condenser.

More specifically, for example, when an engine of an automobile is in an idling state, a drive wind does not flow into the core, so that the capability of cooling the coolant of the condenser and the cooling water of the radiator is decreased. However, when the engine is in an idling state, the revolution speed of the engine is low. For this reason, the cooling performance with regard to the coolant of the radiator is comparatively insignificant. In contrast, the cooling performance with regard to the condenser becomes significant. At this time, if the heat of the coolant of the radiator is transmitted to the coolant of the condenser, the cooling performance of the condenser will be extremely decreased.

Accordingly, in this embodiment, there is a reduction in the transmission of the heat of the cooling water which circulates through the first tank body 455 of the radiator 713 and has a comparatively high temperature to the coolant which circulates through the second tank body 457 of the condenser 711 and has a comparatively low temperature. For example, the deterioration of the cooling performance of the condenser 711 at the time of an idling of an automobile can be effectively mitigated.

In the previously-described integral-type heat exchanger tank, the first and second tank bodies 455 and 457 are integrally molded from aluminum by extrusion, enabling easy and reliable formation of the through hole 737*a* at the time of extrusion.

Figure 36:
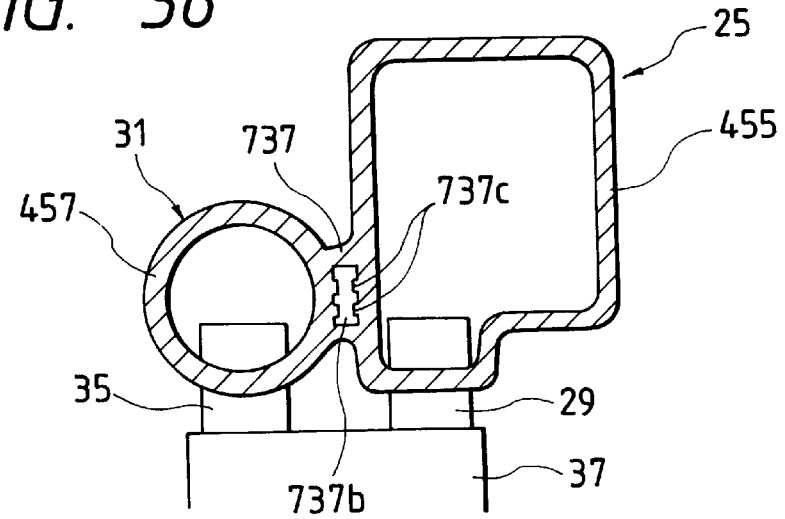
FIG. 36 is a cross sectional view of a modification of an integral-type heat exchanger in FIG. 33.
Figure 37:
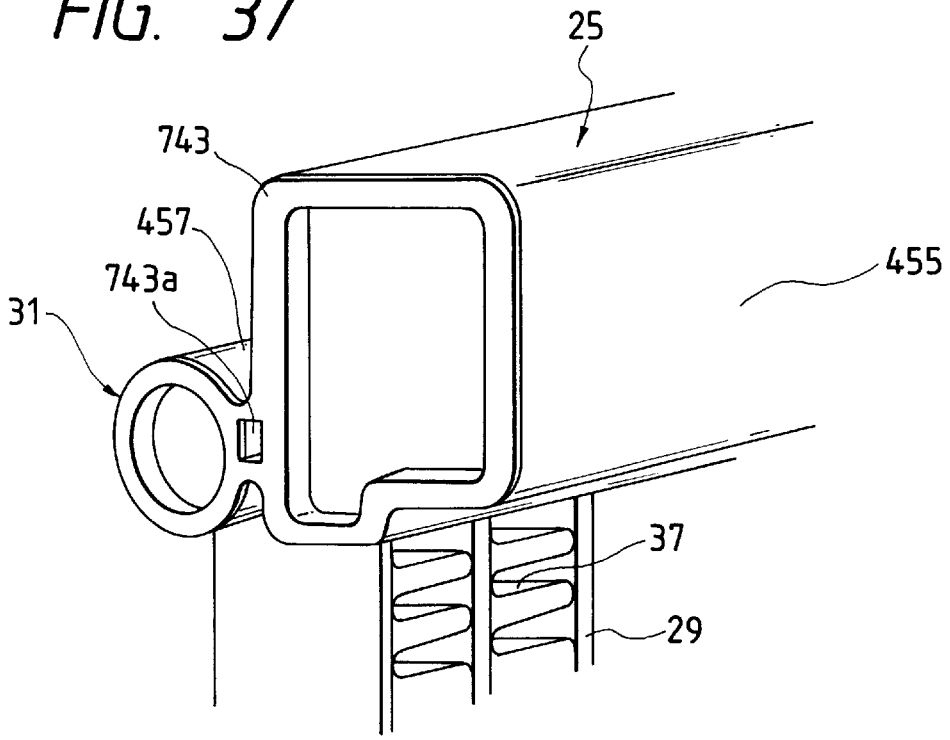
FIG. 37 is a perspective view illustrating the integral-type heat exchanger shown in FIG. 34.
Figure 38:
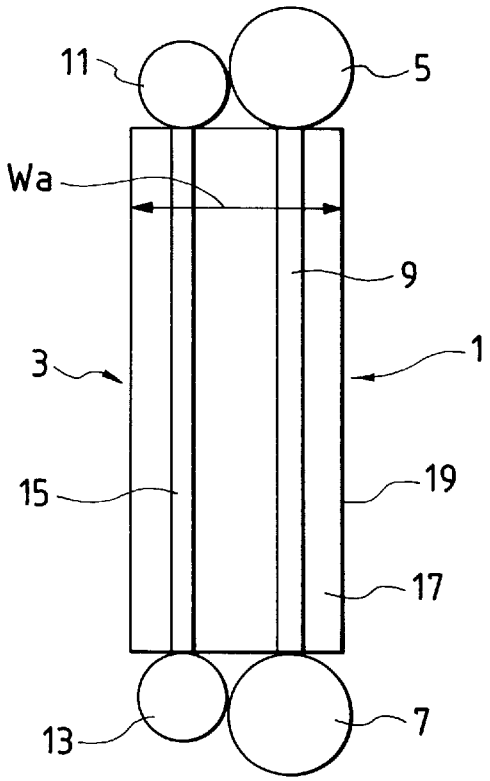
FIG. 38 RELATED ART
FIG. 38 is a plan view illustrating a conventional integral-type heat exchanger.
Figure 39:
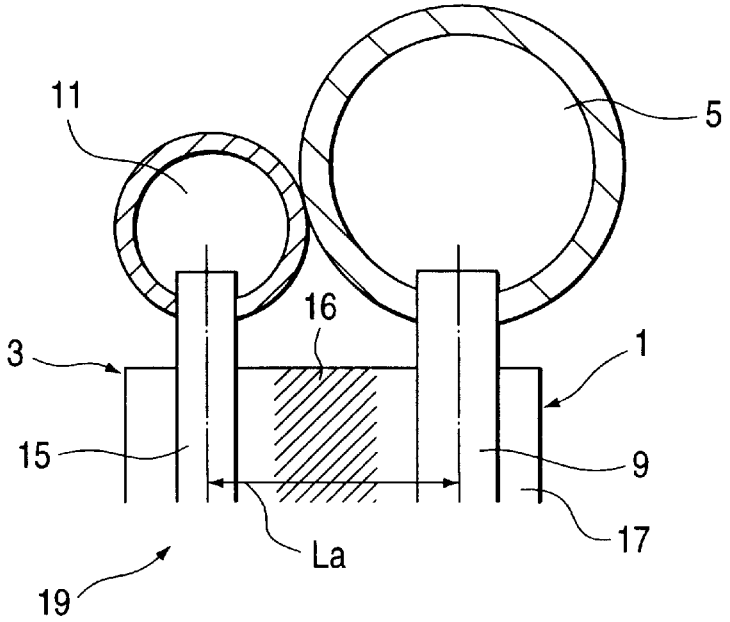
FIG. 39 RELATED ART
FIG. 39 is a cross sectional view of the integral-type heat exchanger shown in FIG. 6.
Figure 40:
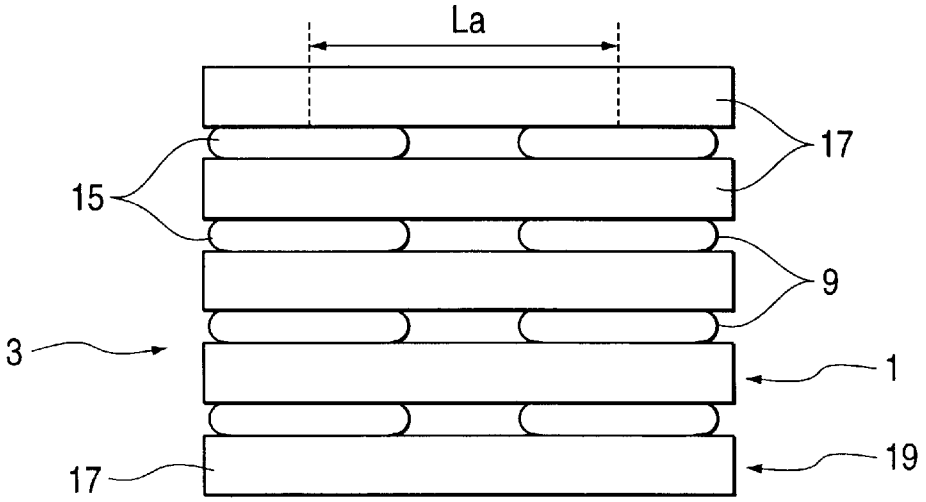
FIG. 40 RELATED ART
FIG. 40 is an explanatory view of a conventional integral-type 41 heat exchanger.
Figure 41:
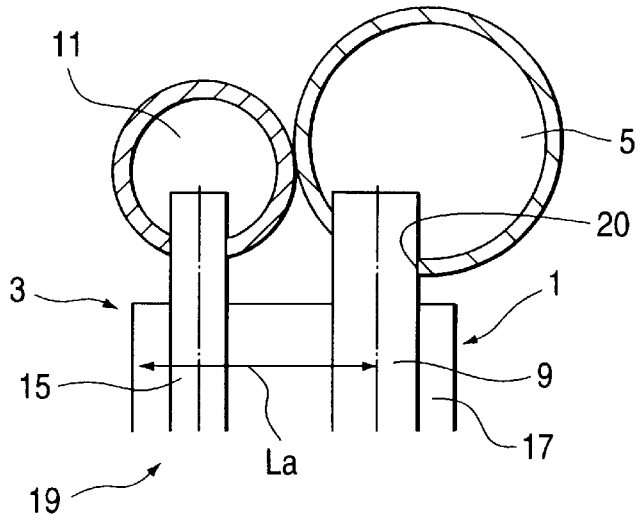
FIG. 41 RELATED ART
FIG. 41 is an explanatory view of the conventional integral-type heat exchanger.

FIGS. 36 and 37 illustrate an integral-type heat exchange tank according to a modification of the aforementioned embodiment. A through hole 737*b* having a rectangular cross section is formed in the partition wall 737 between the first an second tank bodies 455 and 457 and serves as a heat insulation space.

Raised rail-like portions 737*c* which act as a fin are formed on the inner surface of the through hole 737*b*.

The ends of the first and second tank bodies 455 and 457 are closed by aluminum integral-type end plates 743.

Windows 743*a* are formed in the end plates 743 so as to correspond to the through hole 737*b*.

Even in this integral-type heat exchanger tank of the present embodiment, the same effect as that presented by the first embodiment can be obtained. In this embodiment, the raised rail-like portions 737*c* which act as a fin are formed on the internal surface of the through hole 737*b*. The heat of the raised rail-like portions 737*c* are effectively dissipated to air entered from the opening of the through hole 737*b*, enabling effective reduction in the thermal influence exerted between the coolant circulating through the first tank body 455 and the cooling water circulating through the second tank body 457.

As described above, in the present invention, the axes of the tube insertion holes of the first and second heat exchangers are held in parallel with each other, and the second heat exchanger is brought into contact with the plane sections of the first heat exchanger tank, thereby enabling a reduction in the thickness of the heat radiation section (the core) in a simple structure.

The first and second heat exchanger tanks are integrally molded by extrusion, eliminating the need for conventional brazing operations. If there is no brazing of components, the risk of water leakage due to faulty brazing will be eliminated.

Further, the first and second heat exchanger tanks are integrally formed with the header plates. Therefore, the end plates can be easily fitted to both end faces of the first and second heat exchange tanks via the lock members formed in the end plates.

The end plates can be attached to the both ends of the first and second heat exchanger tanks via the lock members by brazing, enabling reliable closing of both ends of the first and second heat exchange tanks in a water-tight manner.

The end plates are attached to both ends of the first and second heat exchange tanks via the lock members, thereby eliminating the risk of inadvertent dislodgment of the end plates during the assembly of the core or the course of travel prior to the brazing operation.

Still further, the first and second heat exchanger tanks are integrally formed with the header plates. Therefore, the end plates can be easily fitted to the second heat exchange tank via the slots formed in the second heat exchange tank.

The partitions can be attached to at least two slots formed in the second heat exchange tank by brazing, enabling reliable formation of a water-tightly-closed space in the second heat exchange tank.

The partitions are attached to the slots formed in the second heat exchange tank, thereby eliminating the risk of inadvertent dislodgment of the end plates during the assembly of the core or through the course of travel prior to the brazing operation.

Furthermore, an increase in the ventilation resistance of the louvers can be reduced while the radiating area is increased by the area corresponding to the joint portion between the heat exchangers.

The parallel louvers can be machined as are the ordinary louvers, and hence they can be machined without fragments.

Further, as described above, a first connector is formed on the side of the first heat exchanger tank opposite to the second heat exchanger tank. The first connector is connected to the second heat exchanger tank via a pipe member penetrating through the first heat exchanger tank. The inlet pipe or outlet pipe of the second heat exchanger is connected to the first connector, which enables reliable connection of the first heat exchanger with the second heat exchanger without the outward projection of the connectors of the second heat exchanger.

Since the connectors of the second heat exchanger are not projected outward, the area of the core can be increased, provided that the opening area of the radiator core panel is constant, thereby enabling improvements on the effectiveness of the heat exchanger.

The clearance between the integral-type heat exchanger tank and the radiator core panel can be reduced, thereby ensuring predetermined cooling performance without sealing the clearance with materials such as urethane.

Since the side of the first heat exchanger tank opposite to the second heat exchanger can be connected to the second heat exchanger, the number of man-hours required for conventional piping operations can be considerably reduced.

A second connector to be connected to the second heat exchanger tank is provided on the side surface of the first heat exchanger tank facing the second heat exchanger tank. The pipe to be penetrated through the first heat exchanger tank is connected to the second connector, enabling facilitated and reliable connection of the pipe to the second heat exchanger tank.

Still further, the first and second upper tanks or the first and second lower tanks are connected together by a joint member, and an upper/lower projection is formed in a jointed area between the portions of the joint member. A collision force exerted on the projections of the joint members is divided between the first and second upper tanks or between the first and second lower tanks via the joint member, thereby realizing ensured prevention of cracks in the upper tanks.

Since the upper projection is formed between the portions so as to be directed upwards, it is possible to reliably prevent the leakage of a fluid to the outside from the tanks even if cracks arise in the vicinity of the projections of the joint members resulting from a collision force acting on the projections.

The first upper tank, the second upper tank or the first lower tank, the second lower tank, and the joint members are made of aluminum, and the joint members are connected at both ends connected to the first upper tank and the second upper tank or to the first lower tank and the second lower tank by brazing. As a result, the joint member can be easily and reliably connected to the first and second upper tanks or the first and second lower tanks.

Furthermore, mounting sections used for mounting the integral-type heat exchanger tank to the body of a car, are projectingly formed outside the areas of end plates corresponding to first and second openings. Therefore, leakage of a fluid to the outside from the tank body can be reliably prevented.

Although the pins are fitted into the mounting holes formed in the end plates by brazing, the mounting holes are provided outside the areas of the end plates corresponding to the first and second openings. Therefore, even if the pins are defectively fitted to the mounting holes by brazing, the leakage of a fluid to the outside from the inside of the tank body can be reliably prevented.

Further, a through hole which serves as a thermal insulation space is formed over and through a partition wall (joint) with which the first tank body and the second tank body are integrally formed. As a result, a mutual thermal influence exerted between the fluid of the first tank body and the fluid of the second tank body can be reduced.

Since the first and second tank bodies are integrally molded from aluminum by extrusion, the through hole can be easily and reliably formed at the time of extrusion molding.

Incidentally, in the aforementioned embodiments, the present invention is applied to the so-called vertical flow type heat exchanger in which the coolant flows vertically between the upper and lower tanks. However, the present invention can be also applied to the so-called horizontal flow type heat exchanger in which the coolant flows horizontally between the right and left tanks except for the sixth embodiment. That is, in the horizontal flow type heat exchanger, the tanks 25, 27 of the first heat exchanger tank 21 and the tanks 31, 33 of the second heat exchanger 23 are disposed right and left in the heat exchanger vertically, and the tubes 29 and 35 are disposed between the right and left tanks 25, 27, 31 and 33 horizontally. Therefore, the coolant flows in the tubes 29 and 35 horizontally.

What is claimed is:

1. An integral-type heat exchanger for an automobile, comprising:

(1) a first heat exchanger including:

a pair of first tanks, each first tank having a plane section perpendicular to a first surface thereof in which a plurality of first tube insertion holes are formed; and a plurality of first tubes to be inserted into said first tube insertion holes so as to connect said pair of first tanks; and (2) a second heat exchanger including:

a pair of second tanks, each second tank having a substantially circular cross section and having a plurality of second tube insertion holes; and a plurality of second tubes to be inserted into said second tube insertion holes so as to connect said pair of second tanks; and (3) a plurality of fins disposed between a plurality of first tubes and between a plurality of second tubes;

wherein axes of said first and second tube insertion holes are held in parallel with each other, and said (1) to (3) members are mounted on the automobile at the same time while said plane section of said first tank is brought into contact with, or is close to said second tank, and wherein said first tank has a substantially angular cross section, and a height of the substantially angular cross section of said first tank is larger than a width of the substantially angular cross sections, wherein a distance between the longitudinal central axes of said first and second tube insertion holes is less than a distance between the longitudinal central axes of said first and second pair of tanks.

2. The integral-type heat exchanger according to claim 1, wherein said first tube insertion holes are located closer to said second tube insertion holes than the longitudinal central axes of said first pair of tanks.

3. An integral-type heat exchanger for an automobile, comprising:

(1) a first heat exchanger including:

a pair of first tanks, each first tank having a plane section perpendicular to a first surface thereof in which a plurality of first tube insertion holes are formed; and a plurality of first tubes to be inserted into said first tube insertion holes so as to connect said pair of first tanks; and (2) a second heat exchanger including:

a pair of second tanks, each second tank having a substantially circular cross section and having a plurality of second tube insertion holes; and a plurality of second tubes to be inserted into said second tube insertion holes so as to connect said pair of second tanks; and (3) a plurality of fins disposed between a plurality of first tubes and between a plurality of second tubes;

wherein axes of said first and second tube insertion holes are held in parallel with each other, and said (1) to (3) members are mounted on the automobile at the same time while said plane section of said first tank is brought into contact with, or is close to said second tank, and wherein said plurality of first tube insertion holes are disposed on said first surface of said pair of first tanks, said first surface being adjacent to said pair of first tanks, and wherein said pair of first tanks includes a stepped portion having a second surface which is parallel to said first surface so that said pair of first tanks have a width larger than a width of said plurality of first tube insertion holes.

* * * * *